US005813390A

United States Patent [19]

Anamoto

[11] Patent Number: 5,813,390

[45] Date of Patent: Sep. 29, 1998

[54] ENGINE FEEDBACK CONTROL EMBODYING LEARNING

[75] Inventor: Takayuki Anamoto, Iwata, Japan

[73] Assignee: Yamaha Hatsudoki Kabushiki Kaisha, Shizuoka-ken, Japan

[21] Appl. No.: 714,945

[22] Filed: Sep. 17, 1996

Related U.S. Application Data

[63] Continuation-in-part of Ser. No. 630,604, Apr. 10, 1996.

[30] Foreign Application Priority Data

Apr. 11, 1995 [JP] Japan ..... 7-85194

[51] Int. Cl.[6] ..... F02D 41/14

[52] U.S. Cl. ..... 123/674

[58] Field of Search ..... 123/674, 675, 123/672, 695

[56] References Cited

U.S. PATENT DOCUMENTS

| | | | |
|---|---|---|---|
| 4,852,010 | 7/1989 | Amano et al. | 123/674 |
| 4,924,836 | 5/1990 | Uchida et al. | 123/674 |
| 5,117,631 | 6/1992 | Moser | 123/674 |
| 5,168,701 | 12/1992 | Yamamoto et al. | 123/674 |
| 5,297,046 | 3/1994 | Nakaniwa | 123/674 |
| 5,464,000 | 11/1995 | Pursifull et al. | 123/674 |
| 5,511,526 | 4/1996 | Hamburg et al. | 123/695 |
| 5,546,916 | 8/1996 | Sudholt et al. | 123/674 |

*Primary Examiner*—Willis R. Wolfe

*Attorney, Agent, or Firm*—Knobbe, Martens, Olson & Bear, LLP

[57] ABSTRACT

A feedback control system and method for operating an internal combustion engine to provide the desired air/fuel ratio under all running conditions. The feedback control operates when the engine is operating at a mid-range rotational velocity and throttle position and when the air/fuel ratio is between about 15 and 16 to 1 to modify the fuel/air ratio from that achieved by a basic setting that is derived from parameters of engine performance so as to maintain the desired ratio. The basic setting is updated based upon previous feedback control corrections in order to minimize the amount of corrections required and reduce hunting.

23 Claims, 29 Drawing Sheets

ENGINE FEEDBACK CONTROL EMBODYING LEARNING

RELATED CASE INFORMATION

This application is a continuation-in-part application of U.S. patent application Ser. No. 08/630,604 filed Apr. 10, 1996 still pending.

BACKGROUND OF THE INVENTION

This invention relates to an engine feedback control system and method and more particularly to such a system and method employing memory learning.

Various control methodology and systems have been employed in conjunction with internal combustion engines so as to improve their performance, particularly in the areas of fuel economy and exhaust emission control. One of the more effective types of controls is a so-called "feedback" control. With this type of control, a basic air/fuel ratio is set for the engine for given engine running parameters. The final adjustment in the air/fuel ratio is made from a sensor that senses the air/fuel ratio in the combustion chamber. Adjustments are then made from the basic setting in order to bring the air/fuel ratio into the desired range.

Normally, the type of sensor employed for such feedback controls is an oxygen ($O_2$) sensor. By determining the amount of oxygen in the exhaust gases from the combustion chamber, it is possible to fairly accurately measure the actual fuel ratio that was delivered to the combustion chamber.

Obviously, this type of system provides a fair amount of hunting. That is, since the system operates on a feedback-control principle, it continuously is making corrections to accommodate deviations from the desired ratio. Frequently, the way these systems operate is that if the mixture strength is determined to be outside of the desired range, adjustments are made in stepped intervals until the sensor output goes to the opposite sense from its previous signal. For example, if the mixture was running rich, then lean adjustments are made until the mixture strength is sensed to be lean. Adjustments are then made back into the rich direction in order to try to maintain the desired ratio.

Obviously this type of system, although very accurate, is required to have a fairly accurate base amount setting so as to avoid or minimize the amount of hunting. If this base amount is set from previously calculated values for the engine, then as engine time and running increases, the basic values may no longer be valid.

In addition, if there are times when feedback control is not desirable or possible, the actual engine control may be based upon these basic values. Again, the base values may not be accurate for the then-running condition of the engine.

It is, therefore, a principal object of this invention to provide an improved feedback control system for an engine.

It is a further object of this invention to provide a feedback control system for an engine wherein the feedback control signals are memorized in a memory so as to provide updated information upon which subsequent controls may be based.

It is a further object of this invention to provide an improved feedback control system and a method for an engine wherein the basic data for determining the initial setting or for determining settings when not operating under feedback control can be more attune to the current engine running conditions and requirements.

SUMMARY OF THE INVENTION

This invention is adapted to be embodied in an internal combustion engine and control method. The engine comprises a combustion chamber and an air-fuel charging system for delivering an air-fuel charge to the combustion chamber for combustion therein. A combustion condition sensor is provided for sensing or detecting the air/fuel ratio in the combustion chamber. A feedback control is employed for adjusting the air/fuel ratio delivered to the combustion chamber in response to the output of the combustion condition sensor. The feedback control preferably operates during a learning control mode which is satisfied when the engine is running at mid-range rotational velocity and throttle position, and when the air/fuel ratio is relatively lean, between 15 and 16 to 1.

In accordance with a method for practicing the invention, data from the feedback control is accumulated and is utilized to provide information for subsequent engine control.

In accordance with an engine, a memory is provided that stores data from the feedback control. The subsequent control of the engine is based upon the memorized data.

DETAILED DESCRIPTION OF THE PREFERRED EMBODIMENTS OF THE INVENTION

Figure 1:
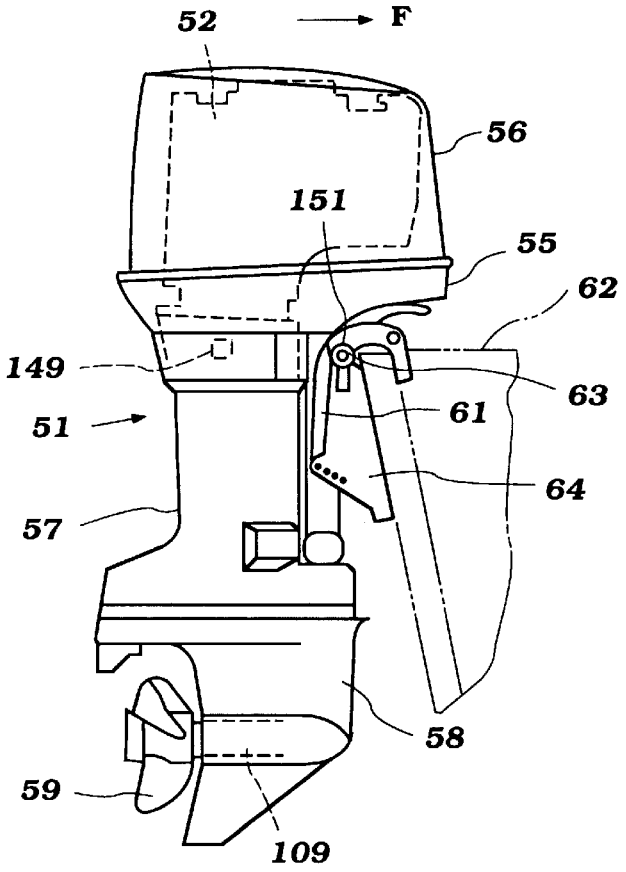
FIG. 1 is a side elevational view of an outboard motor constructed in accordance with an embodiment of the invention.

Referring now in detail to the drawings and to the embodiment of FIGS. 1–6 initially by reference to FIG. 1, an outboard motor constructed and operated in accordance with this embodiment is indicated generally by the reference numeral 51. The invention is shown in conjunction with an outboard motor because the invention has particular utility in conjunction with, although not limited to, two-cycle crankcase compression engines. Such engines are normally used as the propulsion device for outboard motors. For these reasons, the full details of the outboard motor 51 will not be described and have not been illustrated. Those skilled in the art can readily understand how the invention can be utilized with any known type of outboard motor.

The outboard motor 51 includes a power head that is comprised of a powering internal combustion engine, indicated generally by the reference numeral 52. The engine 52 is shown schematically in FIG. 2 and partially in FIGS. 3 and 4. The construction of the engine 52 will be described later, but it should be noted that the engine 52 is mounted in the power head so that its crankshaft, indicated by the reference numeral 53, rotates about a vertically extending axis. The engine 52 is mounted on a guide plate 54 provided at the lower end of the power head and the upper end of a drive shaft housing, to be described. Finally, the power head is completed by a protective cowling comprised of a lower tray portion 55 and a detachable upper main cowling portion 56.

The engine crankshaft 53 is coupled to a drive shaft that depends into and is rotatably journaled within the aforenoted drive shaft housing, which is indicated by the reference numeral 57. This drive shaft then continues on to drive a forward/neutral/reverse transmission, which is contained within a lower unit 58. This transmission and drive arrangement is shown in more detail in FIG. 5 and will be described later by reference to that Figure. This transmission provides final drive to a propeller 59 for propelling an associated watercraft.

A steering shaft (not shown) is affixed to the drive shaft housing 57. This steering shaft is journaled for steering movement within a swivel bracket 61 for steering of the outboard motor 51 and the associated watercraft, shown in phantom and indicated generally by the reference numeral 62, in a well-known manner.

The swivel bracket 61 is, in turn, pivotally connected by a pivot pin 63 to a clamping bracket 64. The clamping bracket 64 is adapted to be detachably affixed to the transom of the associated watercraft 62. The pivotal movement about the pivot pin 63 accommodates trim and tilt-up operation of the outboard motor 51, as is well known in this art. A hydraulically operated mechanism for accomplishing this will be described later by reference to FIG. 6.

Figure 2:
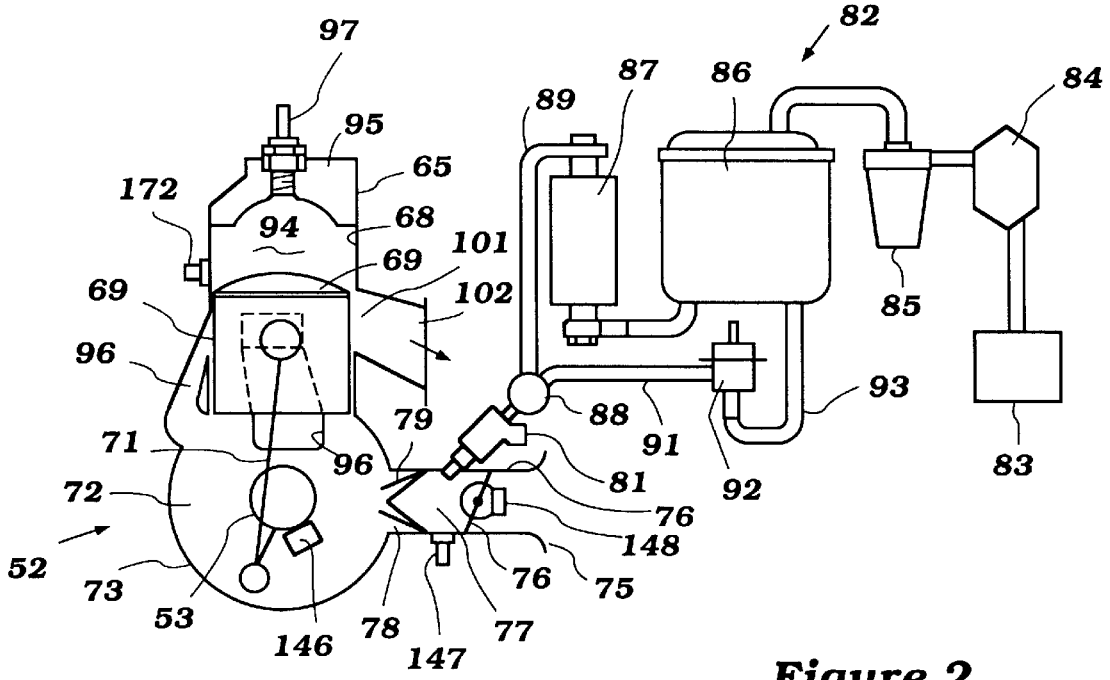
FIG. 2 is a partially schematic cross-sectional view taken through one cylinder of the powering engine of the outboard motor and showing the fuel/air charging system therefor in a schematic form.
Figure 3:
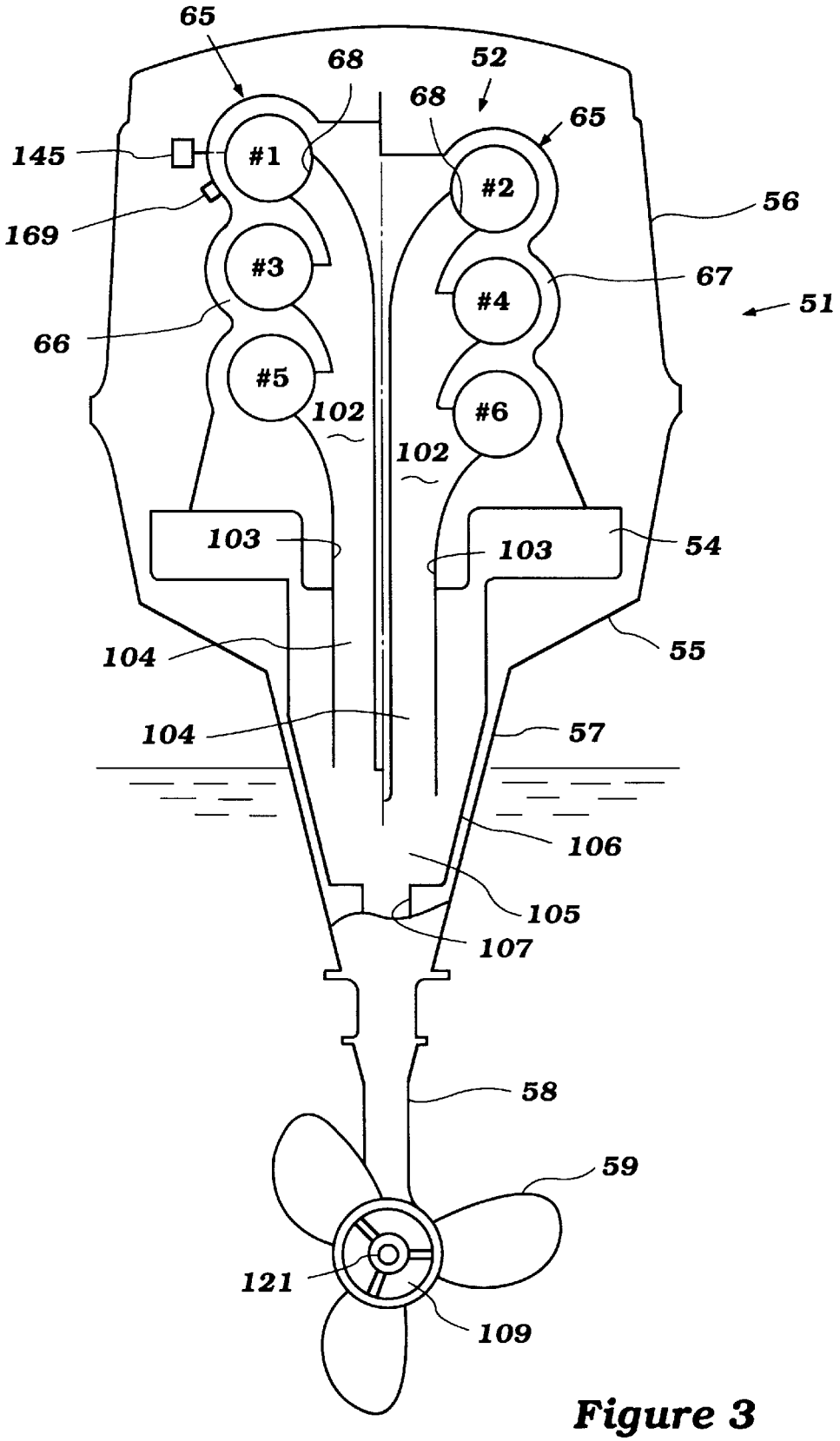
FIG. 3 is an enlarged rear elevational view, with portions broken away, of the outboard motor of this embodiment.
Figure 4:
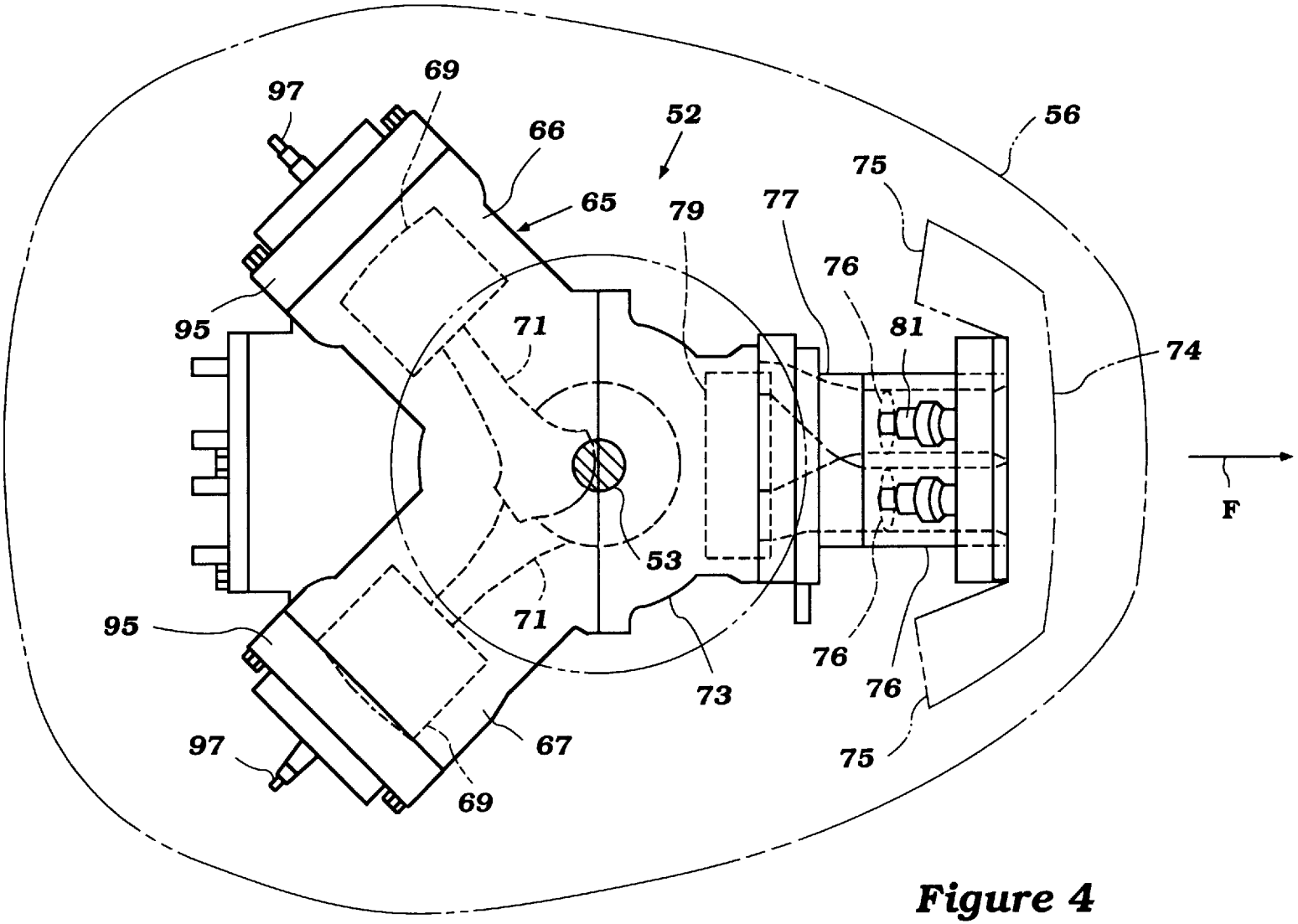
FIG. 4 is a top plan view of the power head of the outboard motor with the protective cowling being shown in phantom.
Figure 7:
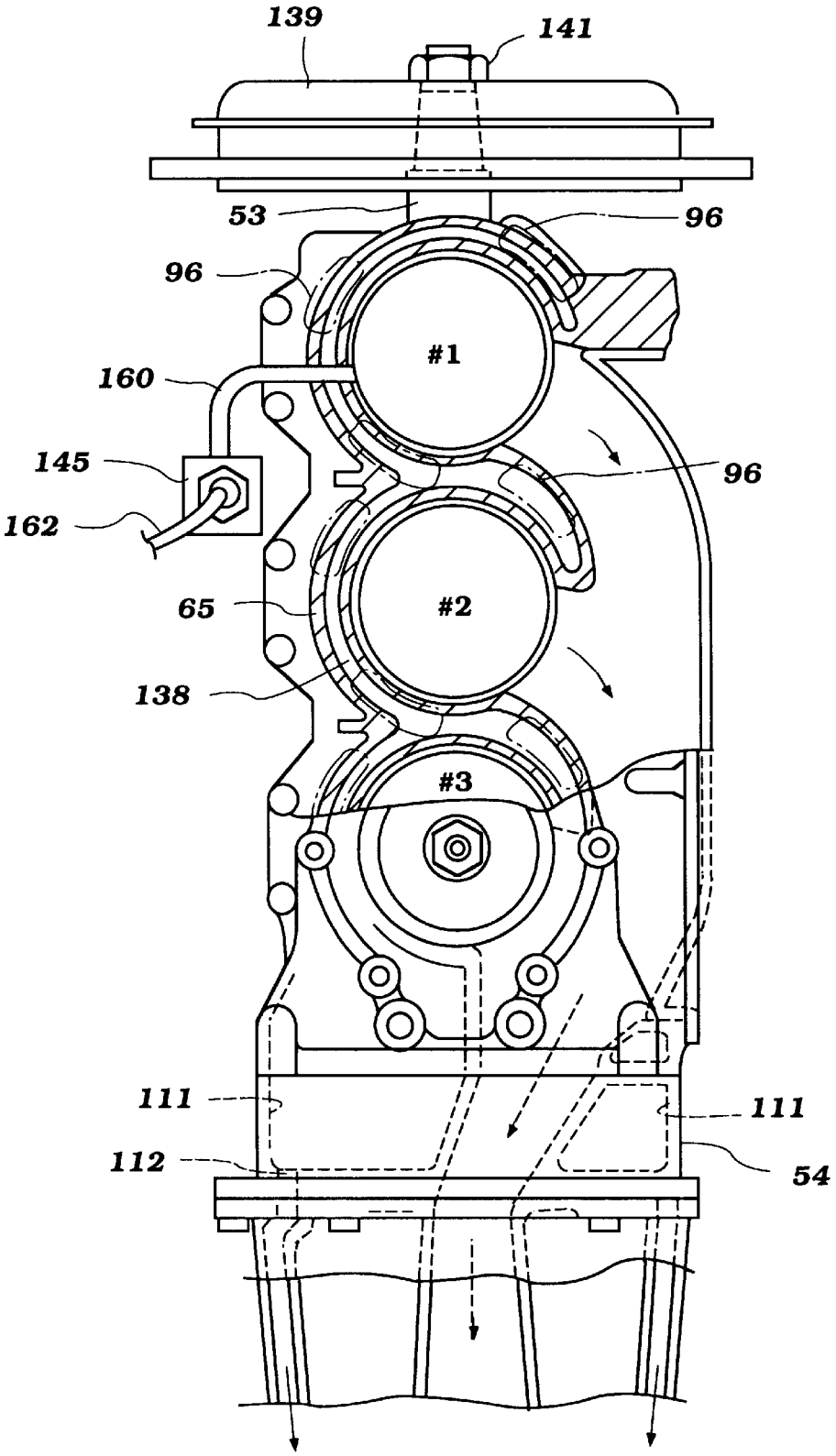
FIG. 7 is a view, in part similar to FIG. 3, with a portion of the engine broken away and shows an embodiment utilized in conjunction with another form of engine.
Figure 8:
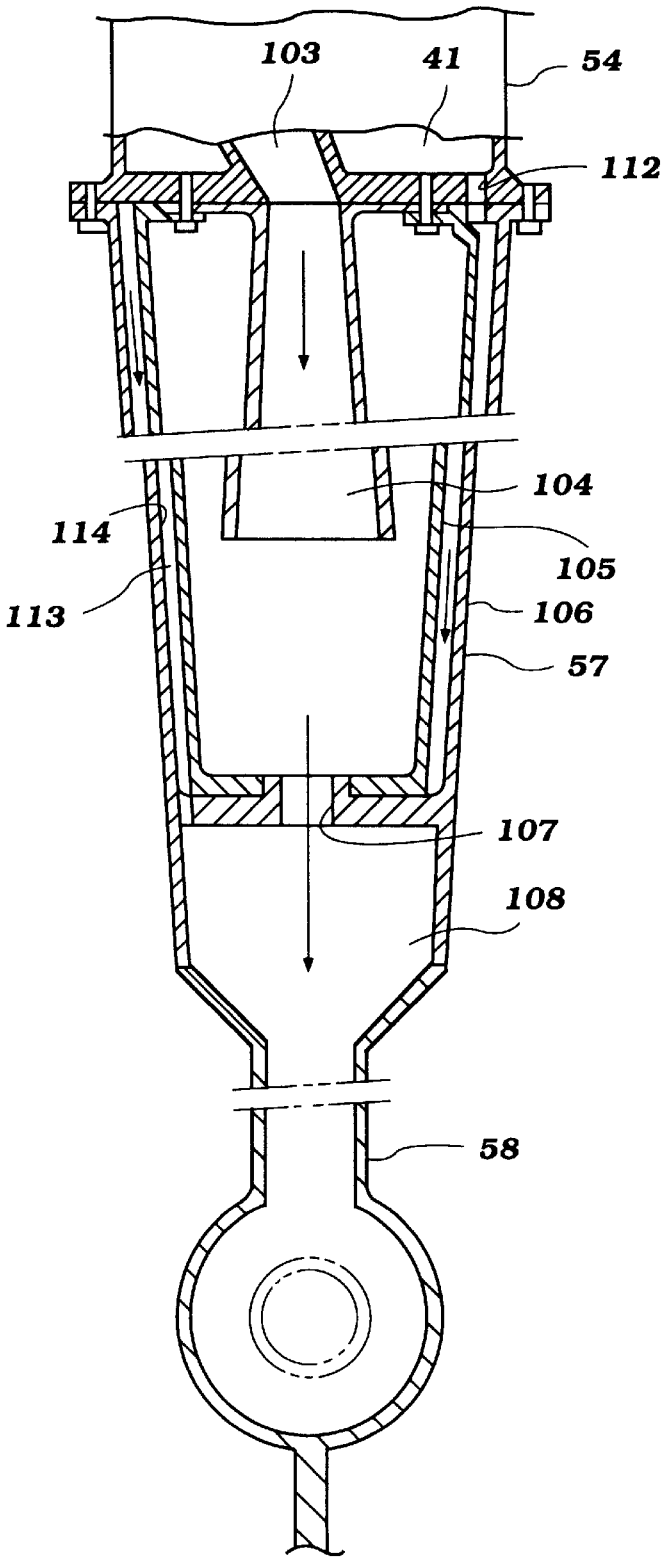
FIG. 8 is a view which in part forms an extension of FIG. 7 and shows the exhaust system and lower unit of this embodiment.
Figure 9:
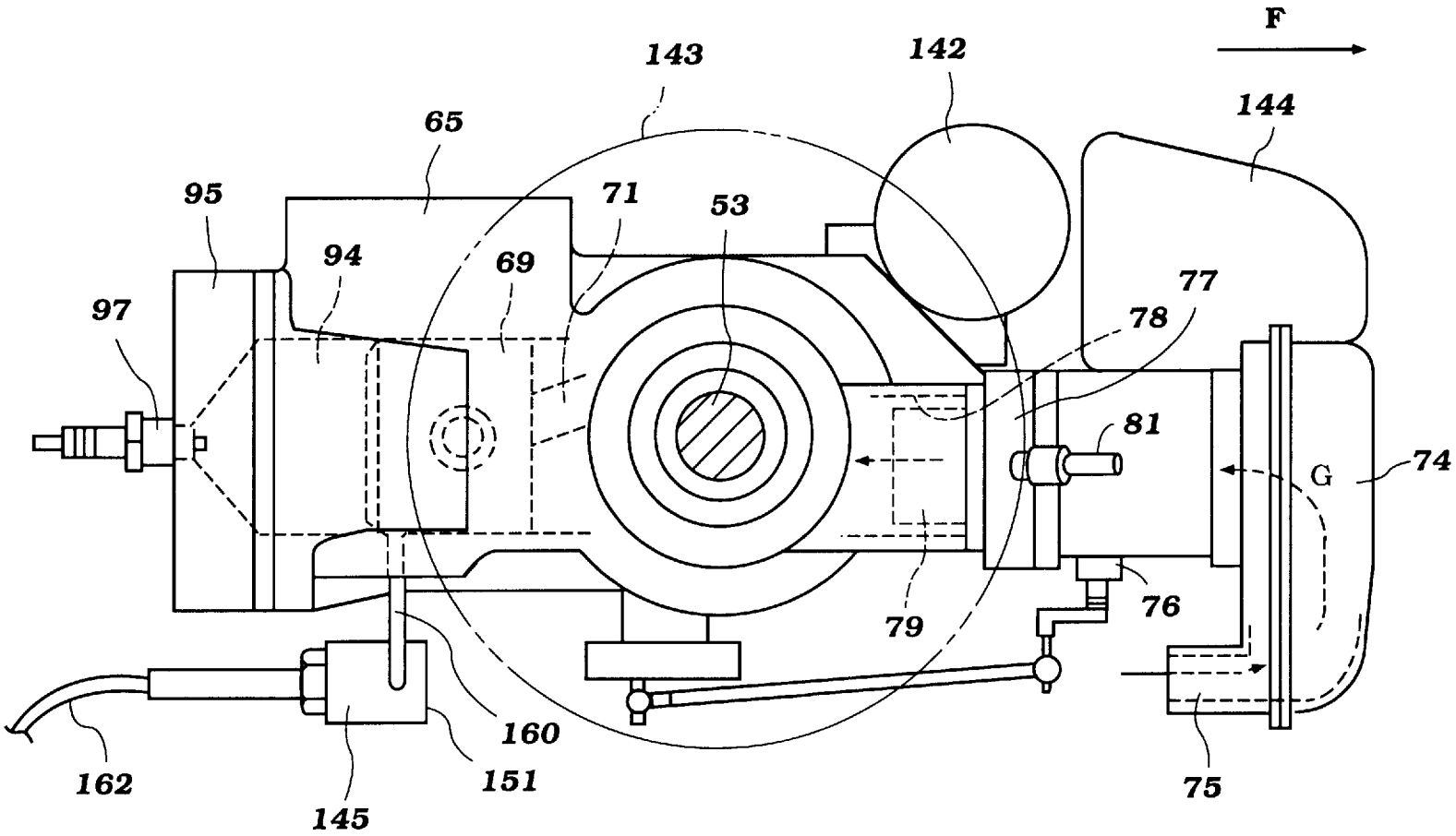
FIG. 9 is a top plan view of the engine constructed in accordance with this embodiment of the invention.

Referring now primarily to FIGS. 2 through 4, the engine 52 is depicted as being of the two-cycle, crankcase compression type and, in this embodiment, is of the V 6 type. Although this particular cylinder configuration is illustrated, it will be apparent to those skilled in the art how the invention may be employed with engines having other numbers of cylinders and other cylinder orientations. A three-cylinder in-line embodiment is shown in FIGS. 7 through 9. As will be apparent to those skilled in the art certain facets of the invention may also be employed with rotary or other ported type engines.

The engine 52 includes a cylinder block 65 having a pair of cylinder banks 66 and 67 in each of which three cylinder bores 68 are formed. These cylinders are numbered #1–#6 as seen in FIG. 3 for descriptive purposes. Pistons 69 reciprocate in these cylinder bores 68 and are connected by means of connecting rods 71 to the crankshaft 53. The crankshaft 53 is, in turn, journaled for rotation within a crankcase chamber 72 in a suitable manner. The crankcase chamber 72 is formed by the cylinder block 65 and a crankcase member 73 that is affixed to it in any known manner.

As is typical with two-cycle crankcase compression engine practice, the crankcase chambers 72 associated with each of the cylinder bores 68 are sealed relative to each other in an appropriate manner. A fuel-air charge is delivered to each of the crankcase chambers 72 by an induction system which is comprised of an atmospheric air inlet device 74 which draws atmospheric air through an inlet 75 from within the protective cowling. This air is admitted to the protective cowling in any suitable manner.

A throttle body assembly 76 is positioned in an intake manifold 77 downstream of the air inlet 75 and is operated in any known manner. Finally, the intake system discharges into intake ports 78 formed in the crankcase member 73. Reed-type check valves 79 are provided in each intake port 78 for permitting the charge to be admitted to the crankcase chambers 72 when the pistons 69 are moving upwardly in the cylinder bore 68. These reed-type check valves 79 close when the piston 69 moves downwardly to compress the charge in the crankcase chambers 72, as is also well known in this art.

Fuel is added to the air charge inducted into the crankcase chambers 72 by a suitable charge former. In the illustrated embodiments, this charge former includes fuel injectors 81, each mounted in a respective branch of the intake manifold downstream of the respective throttle valve 76. The fuel injectors 81 are preferably of the electronically operated type. That is, they are provided with an electric solenoid that operates an injector valve so as to open and close and deliver high-pressure fuel directed toward the intake port 78.

Fuel is supplied to the fuel injectors 81 under high pressure through a fuel supply system, indicated generally by the reference numeral 82 and shown schematically in part in FIG. 2. This fuel supply system 82 includes a fuel tank 83 which is positioned remotely from the outboard motor 51 and preferably within the hull of the watercraft 62 propelled by the outboard motor 51. Fuel is pumped from the fuel tank 83 by means of a low pressure fuel pump 84, which may be electrically or otherwise operated.

This fuel then passes through a fuel filter 85, which preferably is mounted within the power head of the outboard motor 51. Fuel flows from the fuel filter 85 through a conduit into a fuel vapor separator 86, which includes a float controlled valve for controlling the level of fuel in the fuel vapor separator 86. Any accumulated vapor will condense, and excess vapor pressure can be relieved through a suitable vent (not shown).

Also mounted, preferably in the power head, is a high-pressure fuel pump 87 which is driven in any known manner as by an electric motor. In a preferred form this high pressure fuel pump 87 may be positioned directly in the fuel vapor separator 86, although for illustration purposes it is shown separately in FIG. 2. This fuel pump 87 draws fuel from the fuel vapor separator 86 and delivers fuel under high pressure to a fuel rail 88 through a conduit 89. The fuel rail 88 serves each of the injectors 81 associated with the engine.

A return conduit 91 extends from the fuel rail 88 to a pressure regulator 92. The pressure regulator 92 controls the maximum pressure in the fuel rail 88 that is supplied to the fuel injectors 81. This is done by dumping excess fuel back to the fuel vapor separator 86 through a return line 93. The regulated pressure may be adjusted electrically along with other controls, as will be described.

The fuel-air charge which is formed by the charge-forming and induction system as thus far described is transferred from the crankcase chambers 72 to combustion chambers, indicated generally by the reference numeral 94, of the engine. These combustion chambers 94 are formed by the heads of the pistons 69, the cylinder bores 68, and a respective cylinder head assembly 95 that is affixed to each bank 66 and 67 of the cylinder block 65 in any known manner. The charge so formed is transferred to the combustion chamber 94 from the crankcase chambers 72 through one or more scavenge passages 96.

Spark plugs 97 are mounted in the cylinder head 95 and have their spark gaps 98 extending into the combustion chambers 94. The spark plugs 97 are fired by a capacitor discharge ignition system (not shown). This outputs a signal to a spark coil which may be mounted on each spark plug 97 for firing the spark plug 97 in a known manner. The capacitor discharge ignition circuit is operated, along with certain other engine controls such as the regulated fuel pressure, by an engine management ECU, shown schematically and identified generally by the reference numeral 99 in FIG. 12.

When the spark plugs 97 fire, the charge in the combustion chambers 94 will ignite and expand so as to drive the pistons 69 downwardly. The combustion products are then discharged through exhaust ports 101 formed in the cylinder block 65. These exhaust gases then flow from each cylinder bank 66 and 67 through a respective exhaust manifold, shown in FIG. 3 and identified by the reference numeral 102. The exhaust gases then pass downwardly through an opening in the guide plate 54 to an appropriate exhaust system (to be described later) for discharge of the exhaust gases to the atmosphere. Conventionally, the exhaust gases are discharged through a high-speed under-the-water discharge and a low-speed, above-the-water discharge. The systems may be of any type known in the art.

The engine 52 is water cooled, and for this reason, the cylinder block 65 is formed with a cooling jacket (not shown) to which water is delivered from the body of water in which the watercraft is operating. Normally, this coolant is drawn in through the lower unit 58 by a water pump positioned at the interface between the lower unit 58 and the drive shaft housing 57 and driven by the drive shaft. This coolant also circulates through a cooling jacket formed in the cylinder head 95. After the water has been circulated through the engine cooling jackets, it is dumped back into the body of water in which the watercraft is operating. This is done in any known maimer and may involve the mixing of the coolant with the engine exhaust gases to assist in their silencing. This will also be described later.

Although not completely shown in the drawings, the engine 52 is also provided with a lubricating system for lubricating the various moving components of the engine 52. This system may spray fuel into the intake passages in proximity to the fuel injector nozzles 81 and/or may deliver lubricant directly to the sliding surfaces of the engine 52. This lubricant is supplied from a tank mounted at an appropriate location. FIG. 9 shows one possible location for the tank, as will be described later.

Figure 5:
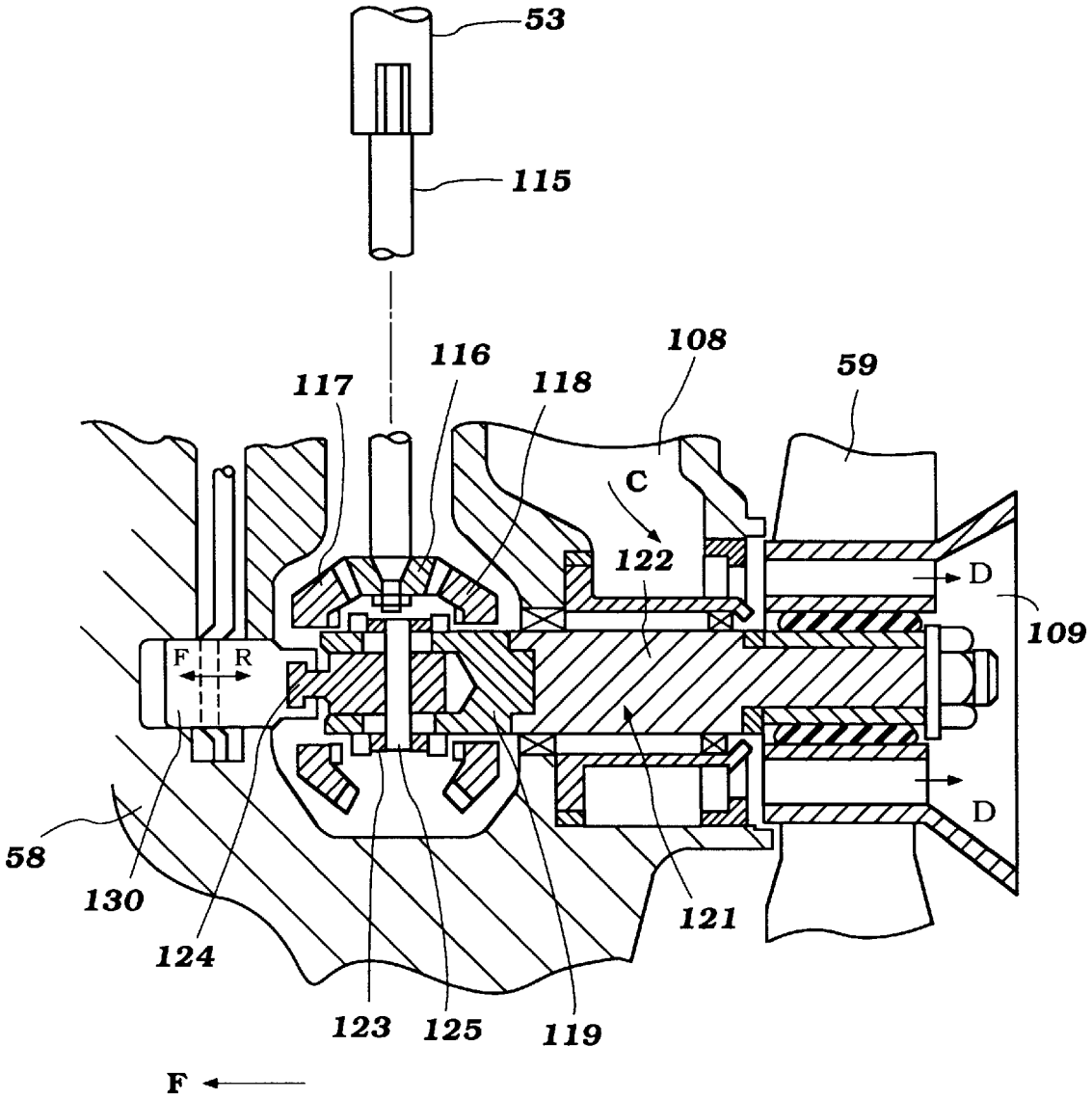
FIG. 5 is an enlarged cross-sectional view showing the transmission in the lower unit of the outboard motor.

Referring now primarily to FIGS. 3 and 5, the exhaust system for discharging the exhaust gases to the atmosphere will be described. As has been noted, the exhaust manifolds 102 communicate with exhaust passages, indicated by the reference numeral 103, that are formed in the spacer or guide plate 54. A pair of exhaust pipes 104 are affixed to the lower end of the guide plate 54 and receive the exhaust gases from the passages 103.

The exhaust pipes 104 depend into an expansion chamber 105 formed within an outer shell 106 of the drive shaft housing 57. This expansion chamber 105 is defined by an inner member which has a lower discharge opening 107 that communicates with an exhaust chamber 108 formed in the lower unit 58 and to which the exhaust gases flow.

A through-the-hub, high speed, exhaust gas discharge opening 109 is formed in the hub of the propeller 59 and the exhaust gases exit the outboard motor 52 through this opening below the level of water in which the watercraft 62 is operating when traveling at high speeds. In addition to this high speed exhaust gas discharge, the outboard motor 51 may be provided with a further above-the-water, low speed, exhaust gas discharge (not shown). As is well know in this art, this above-the-water exhaust gas discharge is relatively restricted, but permits the exhaust gases to exit without significant back pressure when the watercraft 62 is traveling at a low rate of speed or is idling, and the through-the-hub exhaust gas discharge 109 will be deeply submerged.

As has been previously noted, the cooling water from the engine cooling jacket may also be mixed with the exhaust gases. To accomplish this, the guide plate 54 is provided with a cooling jacket 111 (FIGS. 7 and 8) which extends around the exhaust passage 103 and into which the spent cooling water from the engine 52 is returned. This water is then drained through one or more drain openings 112 formed in the lower surface the guide plate 54. These openings 112 communicate with a water jacket 113 which is formed in the space 114 existent between the outer shell of the expansion chamber 105 and the inner surface of the drive shaft housing outer shell 106. This water is then discharged back into the body of water in which the watercraft 62 is operating through outlets (not shown) in the lower unit 58.

The drive connection between the engine crankshaft 53 and the propeller 59 will now be described by reference to FIG. 5. As has been noted, the engine crankshaft 53 rotates about a vertically extending axis so as to facilitate coupling to the drive shaft which was previously mentioned as being rotatably journaled within the drive shaft housing 57. This drive shaft is shown in FIG. 5 and is indicated by the reference numeral 115.

This drive shaft 115 depends into the lower unit 58 where it is connected for rotation with a driving bevel gear 116 of a reversing transmission of a type conventionally utilized in this art. This reversing transmission is comprised of a forward drive bevel gear 117 and a reverse drive bevel gear 118 which gears are mounted for rotation on a portion 119 of a drive shaft assembly, indicated generally by the reference numeral 121. This drive shaft assembly 121 includes a further piece 122 that is coupled for rotation with the transmission portion 119 and which is connected drivingly to the hub of the propeller 59 in a conventional manner.

A dog clutching sleeve 123 is splined onto the drive shaft portion 119 and has dog clutching teeth that are adapted to be brought into meshing engagement with corresponding teeth formed on either the forward drive bevel gear 117 or the reverse drive bevel gear 118. When the dog clutching sleeve 123 is in the position shown in FIG. 5, the transmission is operating in a neutral condition.

The dog clutching sleeve 123 is moved between its positions by means of a plunger 124 that carries a shift pin 125 that passes through a slot in the drive shaft portion 119 and which is coupled to the dog clutching sleeve 123 for effecting its movement. A shift actuator 130 has a connection to the shift plunger 124 that permits it to rotate but which can effect axial movement as shown by the arrows in FIG. 5 between the forward, neutral and reverse positions.

Figure 6:
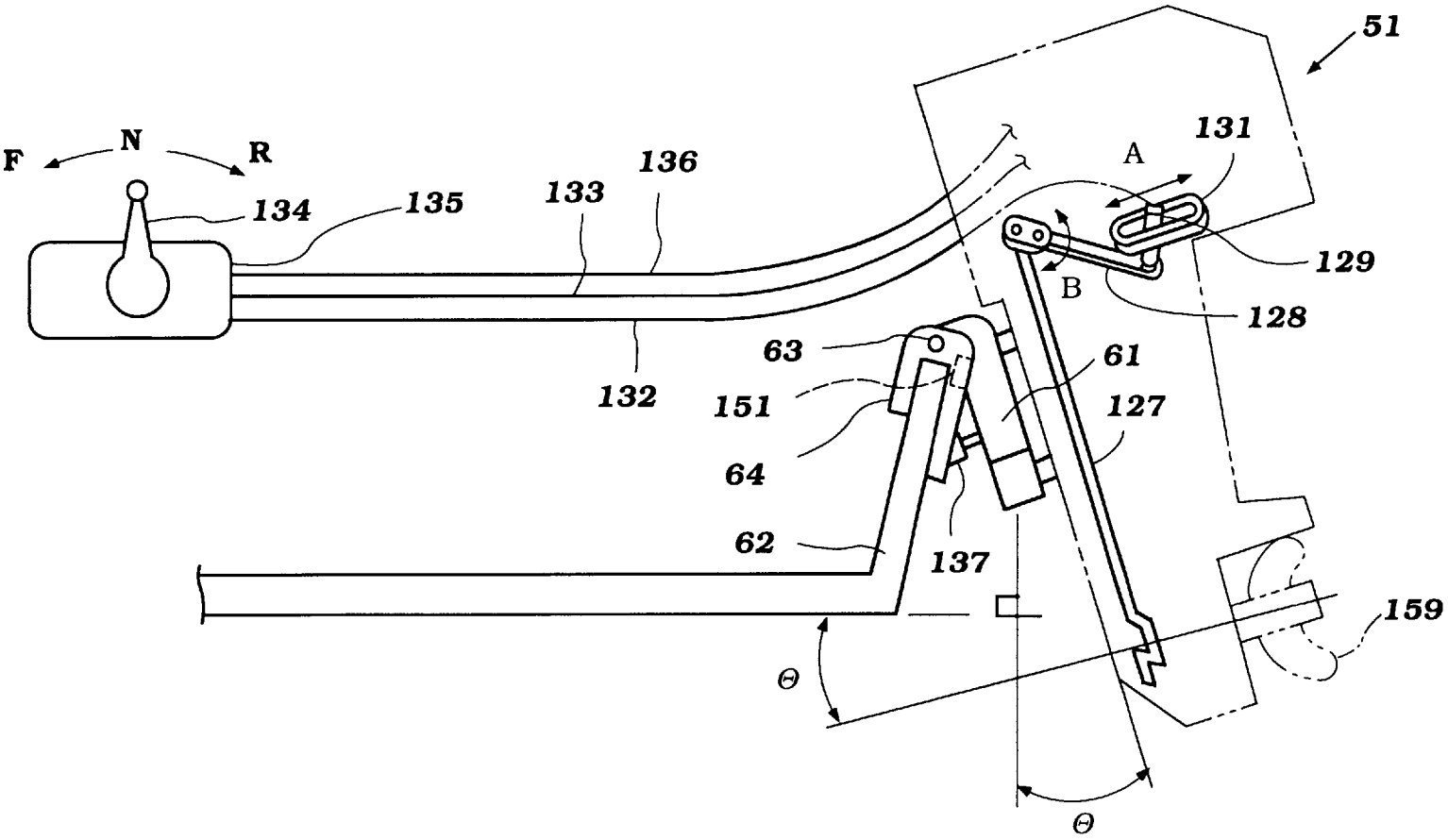
FIG. 6 is an enlarged view, in part similar to FIG. 1, but looking from the opposite side, and shows the single lever control for controlling the throttle and transmission and also showing the trim and tilt mechanism associated with the outboard motor.

This clutch actuating plunger 124 is formed with a slot 126 in which the crank end of a shift rod 127 is positioned. The shift rod 127 is rotatably journaled within the drive shaft housing 57 and carries, at its upper end as seen in FIG. 6, an actuating arm 128 that carries a pin 129. The pin 129 is received in a shift actuator 131 which is coupled to a wire actuator 132 for its operation. The actuator 132 is operated by a single lever control, indicated generally by the reference numeral 134 and which is mounted in the hull of the watercraft 62 in position adjacent the operator on a mounting base 135.

In addition, a pair of throttle control wires 133 and 136 are also actuated by the single lever control 134 for operating the throttle valves 76. As is well known in this art, operation of the single lever control 134 from the neutral to the forward or reverse directions effects first operation of the transmission and specifically the shift rod 127 until engagement is made. Further movement of the single lever control 134 then begins to open the throttle valve, as is well known in this art.

Also seen in FIG. 6, is a hydraulic cylinder 137 which is operative to effect tilt and trim movement of the outboard motor 51 in a well known manner. The trim movement is in the range θ while the tilt up movement is from the range θ up to the tilted up, out of the water position, as is well known in this art.

As has been noted, the engine 52 shown in the embodiment of FIGS. 1–6 is of the V-6 type, but the invention is capable of use with engines having other cylinder numbers and other orientations of the cylinders. FIGS. 7–9 show a three cylinder in-line engine to illustrate how the invention can be applied to an in-line engine. Basically, the engine shown in these figures is the same as a single bank of the engine 22 of the embodiment of FIGS. 1–6. Therefore, the detailed construction of this embodiment will be described only insofar as it relates to additional components which are not shown in the other embodiment. FIGS. 7 and 8 are composite views which correspond to FIG. 3 of the earlier embodiment and FIG. 9 is a top plan view that corresponds to FIG. 4 of the previously-described embodiment.

Shown in this embodiment but not in the previously-described embodiment is the cooling jacket for the cylinder block, this being indicated generally by the reference numeral 138. The arrows in FIGS. 7 and 8 show how the exhaust gases and cooling water exit the outboard motor. Also shown in these figures is a flywheel magneto 139 that forms a portion of the ignition system and which is affixed to the upper end of the crankshaft 53 by means of a nut 141 and key (not shown).

FIG. 9 shows some additional components which also are not shown in the previously described embodiment and these include a starter motor 142 that cooperates with a starter gear 143 formed on the flywheel magneto 139 for starting of the engine. Also depicted in this figure is oil tank 144 for containing lubricating oil for the engine. It is believed that this is sufficient discussion of these figures so as to permit those skilled in the art to understand how the invention may be applied with a three cylinder engine.

It has been noted that the ECU 99 controls the capacitor discharge ignition circuit and the firing of the spark plugs 97. In addition, the ECU controls the fuel injectors 81 so as to control both the beginning and duration of fuel injection and the regulated fuel pressure, as already noted. The ECU 99 operates on a strategy for the spark control and fuel injection control 81 as will be described. This system employs an exhaust sensor assembly indicated generally by the reference numeral 145 constructed as will be described later in more detail by reference to FIG. 10.

So as to permit engine management, a number of sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors which appear in FIGS. 1 through 3 include a crankshaft position sensor 146 which senses the angular position of the crankshaft 53 and also the speed of its rotation. A crankcase pressure sensor may also provided for sensing the pressure in the individual crankcase chambers 72. Among other things, this crankcase pressure signal may be employed as a means for measuring intake air flow and, accordingly, controlling the amount of fuel injected by the injector 81, as well as its timing.

A temperature sensor 147 may be provided in the intake passage downstream of the throttle valve 76 for sensing the temperature of the intake air. In addition, the position of the throttle valve 76 is sensed by a throttle position sensor 148.

In accordance with some portions of the control strategy, it may also be desirable to be able to sense the condition of the described transmission for driving the propeller 59 or at least when it is shifted into or out of neutral. Thus, a transmission condition sensor 149 is mounted in the power head and cooperates with the shift control mechanism for providing the appropriate indication.

Furthermore, a trim angle sensor 151 is provided for sensing the angular position of the swivel bracket 61 relative to the clamping bracket 64.

The types of sensors which may be utilized for the feedback control system provided by the ECU 99 are only typical of those which may be utilized in conjunction with the invention. Additional of these sensors will be pointed out later by reference to FIG. 12.

As has been noted, the invention deals primarily with the feed back control utilizing the oxygen sensor 145. For that reason, further details of the description of the components of the engine and outboard motor that have no particular importance in conjunction with the understanding of the construction and operation of the feed back and related control and thus have been deleted.

Figure 10:
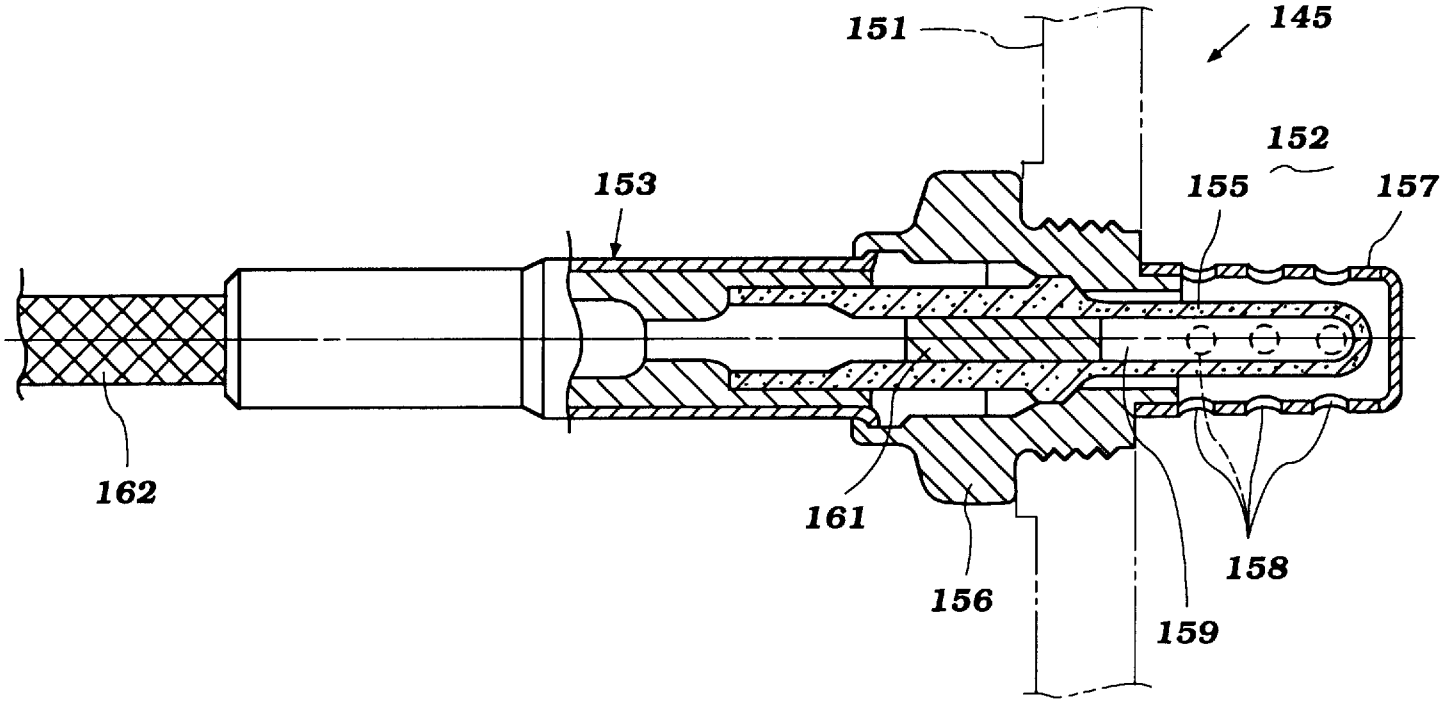
FIG. 10 is an enlarged cross-sectional view showing an embodiment of sensor which may be utilized in conjunction with the invention.

The sensor assembly 145 has a construction as best shown in FIG. 10, although its interaction with the engine will be described later by reference to other figures. The sensor assembly 145 is comprised of an outer housing assembly, indicated generally by the reference numeral 151, and which in the embodiments of FIGS. 1–7 and 7–9, consists of an outer housing piece that defines a relatively large accumulator volume 152.

A sensor element, in this case an oxygen ($O_2$) sensor, indicated generally by the reference numeral 154, has its sensing portion 155 mounted within a fitting 156 which, in turn, has a threaded connection 157 with the outer housing 151, so that the sensor portion 155 extends into the accumulator chamber 152. However, the sensor portion 155 is protected by means of a protecting shell 157 that is fitted onto a tubular projection of the mounting fitting 156. A plurality of openings 158 are formed in the shell 157 so as to permit the communication of exhaust gases with the sensor portion 155, but also to protect the sensor portion 155 from damage.

The sensor portion 155 is formed as a platinum-plated glass tube having a hollow center 159. An electrical heater 161 extends in the hollow center 159 along the centerline of the sensor 155 and which communicates with the ECU 99 through a shielded conductor 162. As is known, the element 155 will output a signal indicative of oxygen content in the exhaust gas, and thus provides an indicator whether the fuel/air mixture is stoichiometric or not. The actual constituency of the sensor 155 may be of any desired type utilized in this control art.

In the embodiments of FIGS. 1–5 and FIGS. 7–9, the oxygen or combustion condition sensor 145 has been positioned in direct registry with the combustion chamber or exhaust port of one of the cylinders, cylinder number 1 in each of the specific embodiments described. An external tube 160 is used for this purpose in the embodiment of FIGS. 7 through 9. This system, as will become apparent, deal with the sensing of the combustion condition, i.e., air fuel ratio, in only one combustion chamber and controlling all remaining combustion chambers as well as that chamber from the output of this sensor.

Preferably, the oxygen sensor 145 is positioned so as to communicate directly with the combustion chamber either through the wall of the cylinder bore or into the exhaust manifold portion serving that cylinder. However, to facilitate positioning and still obtain this result, it may be possible to mount the sensor 145 in a common portion of the exhaust system and FIG. 11 shows such an embodiment.

Figure 11:
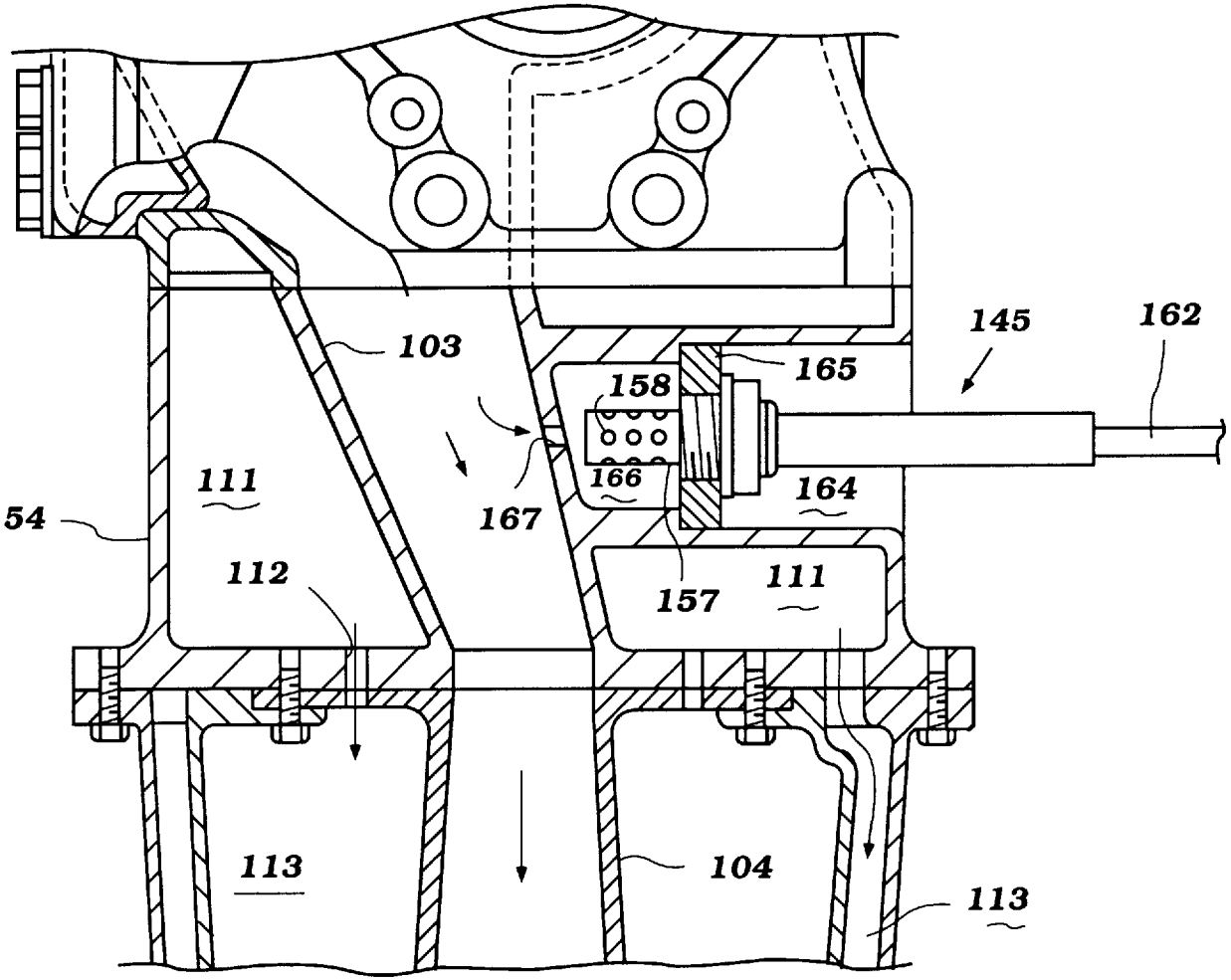
FIG. 11 is a cross-sectional view, in part similar to FIGS. 7 and 8 in the area where the power head meets the upper end of the drive shaft housing and shows a further embodiment of the invention.

Referring specifically to FIG. 11, it will be seen that the guide plate 54 is provided with a recess 164 formed on one side thereof and into which a mounting plate 165 is positioned. The sensor 145 is mounted in this mounting plate 165 and its actual sensor portion 155 and the shield 157 in which the openings 158 are formed extends into a further cavity 166 formed between the exhaust passage 103 and the mounting plate 165. This cavity communicates with the exhaust passage 103 through a small port 167. The readings from the sensor 145 are taken at selected time intervals in relation to the actual angular position of the crankshaft 53 so as to sense the exhaust gas constituency of the exhaust gases from the selected cylinder (i.e., cylinder number 1 in the described embodiments) without dilution from the exhaust gases from the other cylinders. This may be done by switching the times when the readings from the sensor 145 are taken as should be readily apparent to those skilled in the art.

Figure 12:
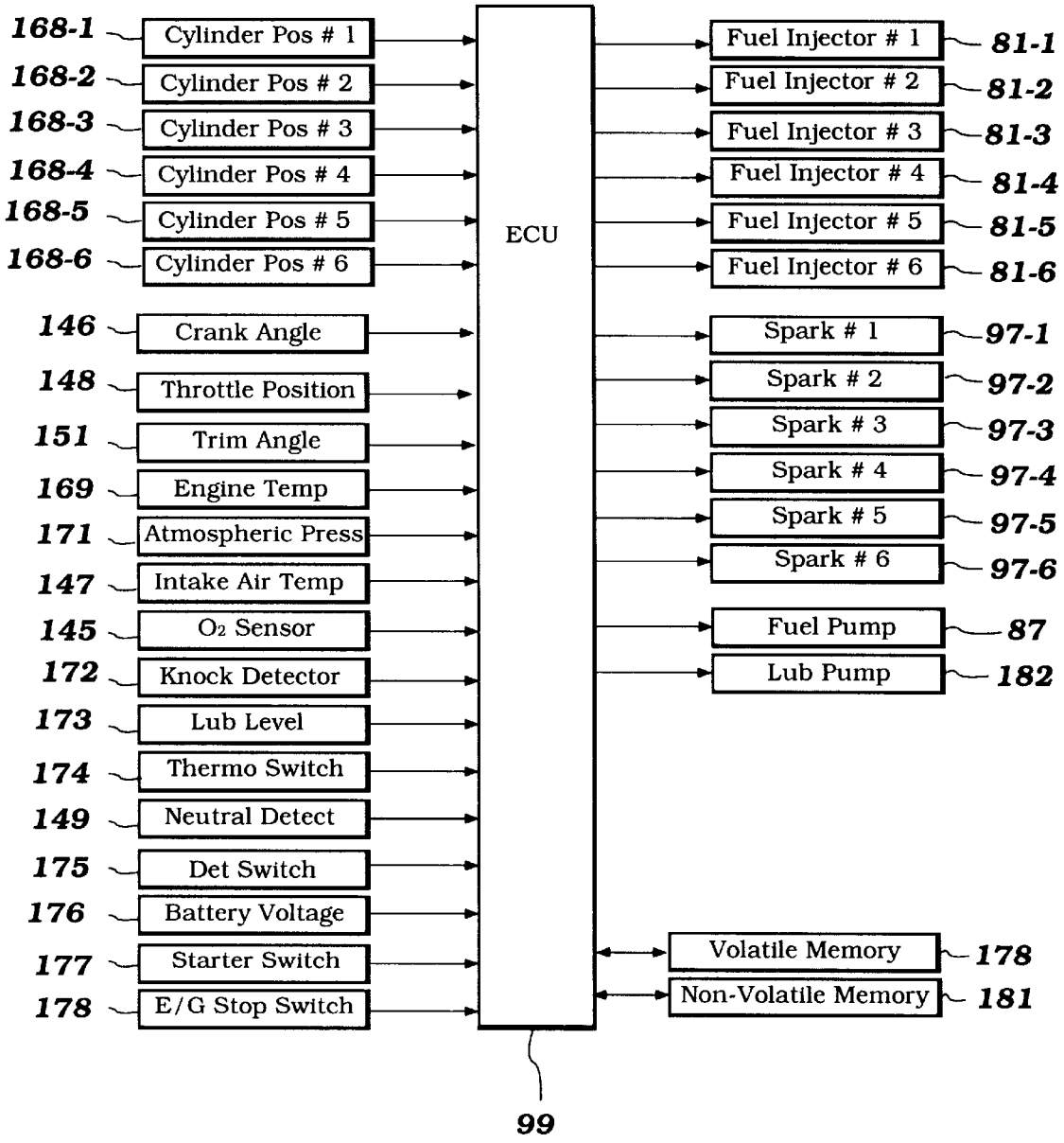
FIG. 12 is a diagrammatic view showing the relationship of the various detectors to the ECU and the relationship of the ECU to certain controlled portions of the engine, specifically the fuel injectors, ignition system, fuel pump, and oil pump.

Having thus described the basic construction of the engine 52 and the associated components of the outboard motor 51 which are involved with the engine control, the relationship of the various control elements and sensors will now be described by particular reference to FIGS. 12 and 13. Referring first to FIG. 12, this shows the ECU 12 and its input and output signals which includes the output signals to the fuel injectors 81 and the spark plugs 97 for controlling the time of beginning of injection of each of the fuel injectors 81, the duration of injection thereof and also the timing of firing of the spark plugs 97. Certain of the detectors for the engine control have already been described and these include the oxygen sensor 145, the crank angle sensor 146, the intake air temperature sensor 147, the throttle position detector 148, the transmission neutral detector switch 149 and the trim angle sensor 151. In addition, each cylinder is provided with a respective detector 168 which is associated with the crankshaft and indicates when the respective cylinder is in a specific crank angle. This may be such a position as bottom dead center (BDC) or top dead center (TDC). These sensors cooperate along with the basic crank angle position sensor 146 and provide indications when the respective cylinders are in certain positions as noted.

There is also provided an engine temperature sensor 169 which is mounted in an appropriate body of the engine and which senses its temperature. For example, these sensors may, in fact, be disposed in communication with one of the cooling jackets of the engine and such a sensor is shown in FIG. 3 and is mounted so as to sense the portion of the engine cooling jacket surrounding number 1 cylinder in the cylinder bank 66. Obviously, other types of sensor locations may be employed.

As will become apparent, the output of the engine temperature sensor 169 may be utilized also to detect when the engine is in an over-heat mode and initiate protective action so as to permit the engine to continue to operate, but restrict its speed if an overtemperature condition exists. This speed limitation may be accomplished by disabling the operation of one or more of the engine cylinders. As will also become apparent, the actual cylinder which is disabled may be changed during this protective running mode so that all cylinders will fire at least some times, but certain cylinders will be skipped during one or more cycles. This will ensure against plug fowling, etc. during this protective mode.

There is also provided an atmospheric air pressure detector 171 that provides a signal indicative of atmospheric air pressure for engine control.

The engine may also be provided with a knock detector 172, which appears schematically in FIG. 2 and which outputs a signal when an knocking condition is encountered. Any appropriate control may be utilized for minimizing knocking, such as changing spark timing and/or fuel injection amount and timing as will also be discussed later.

It has also been noted that the engine 52 may be provided with a separate lubricating system that includes a lubricate tank. This lubricant tank, as has been noted, is shown at 144 in FIG. 9. There may be provided a lubricant level detector 173 that also provides a signal indicative of when the lubricant level is below a predetermined value. Like overheat conditions, this low lubricant level may be employed as a warning and the engine speed can be limited when the lubricant level, as sensed by the sensor 173, falls below a predetermined level. Any well known system for accomplishing this can be provided.

In addition to the engine temperature sensor 169, there may be also provided a thermal switch 174 that can be set to signal when an over-temperature condition exists as opposed to utilizing the output of the engine temperature sensor 169.

In some applications, there may be two outboard motors 51 mounted on the transom of the same watercraft. In such arrangements, if an abnormal conditions exists in one of these outboard motors and its speed is limited in the aforenoted manner, it is also desirable to ensure that the other outboard motor also has its speed limited. This improves directional control. There have been disclosed in the prior art various arrangements for providing this interrelated control and such a control is indicated schematically as 175 and is referred to as a DES (Dual Engine System) detector. This is a crossover circuit which provides the signal for engine speed control to be transmitted to the normally operating engine as well as to the abnormally operating engine for the aforenoted reasons.

In addition to the actual engine and transmission condition detectors there may also be provided detectors that detect the condition of certain controls and auxiliaries such as a battery voltage detector 176, a starter switch detector 177 and an engine stop or kill switch detector 178. If battery voltage is below a predetermined value, certain corrective factors may be taken. Also, when the engine starter switch is actuated as indicated by the starter switch detector 177, the program can be reset so as to indicate that a new engine cycle of operation will be occurring. The engine stop switch detector 178 is utilized so as to provide a shutdown control for stopping of the engine which also may be of any known type.

In addition to those inputs noted, various other ambient engine or related inputs may be supplied to the ECU for the engine management system.

The ECU also is provided with a memory that is comprised of a volatile memory 179 and a nonvolatile memory 181. The volatile memory 179 may be employed for providing certain learning functions for the control routine. The nonvolatile memory 181 may contain maps for control during certain phases of non-feedback control, as will be also apparent. The ECU 99 also controls, in addition to the fuel injectors 81 and the firing of the spark plugs 91, the high pressure fuel pump 87 and the lubricating pump which has been referred to but which has not been illustrated. This lubricating pump is shown schematically at 182 in FIG. 12. Obviously, those skilled in the art will understand how these various controls cooperate with the components of the engine to provide their control, as will become apparent.

Figure 13:
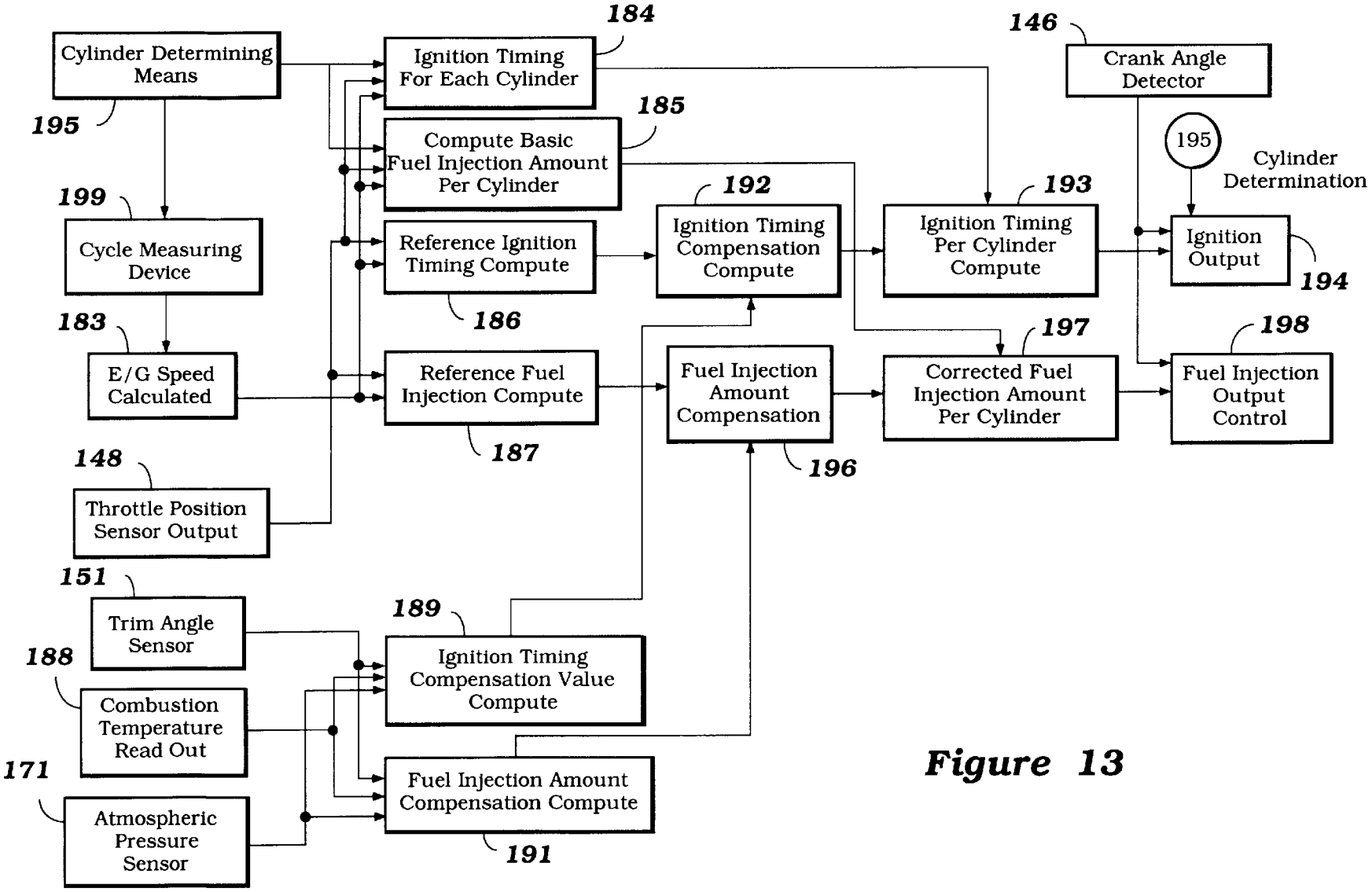
FIG. 13 is a further block diagram showing how the various detectors are interrelated to the various computing portions of the ECU and the outputs to the ignition and fuel controls.

Referring now to FIG. 13, this figure illustrates certain of the sensor outputs previously referred to and particularly in connection with FIG. 12 and the various sections of the ECU 99 and how they interrelate with each other so as to provide the basic fuel injection and ignition controls. This figure is obviously schematic and does not show all of the interconnections between the various sensors and control sections of the ECU 99. However, this figure is useful in permitting those skilled in the art to understand how the systems are interrelated before the actual control sequence will be described. FIG. 13 also shows primarily the method and apparatus by which the determination of the basic fuel injection timing and amount and ignition timing are determined.

Referring now specifically to this figure, the system includes a first section wherein the basic ignition timing, fuel injection timing and duration are computed. These basic timings and amounts are made from measuring certain engine parameters such as engine speed and load. In this embodiment, engine speed, calculated at the section 183, is determined by counting the number of pulses from the crank angle sensor 146 in a unit of time. In addition to providing the signal indicative of crank angle, by summing the number of pulses from the sensor 146 in a given time interval it will be possible to determine the actual engine rotational speed.

In addition to measuring the engine speed in order to obtain the basic control parameters, the engine load is also measured. This is done by utilizing the output of the throttle position sensor 148 although various other factors which determine the load on the engine can be utilized.

The outputs from the engine speed determination and throttle opening or load are sent to a number of calculating sections in the ECU 99. These include a section 184 that computes the ignition timing for each cylinder. This information is derived from an appropriate map such as may be reserved in the aforenoted nonvolatile memory 181 and is based upon the time before or after top dead center for each cylinder. By taking this timing and comparing it with the actual crankshaft rotation, the appropriate timing for all cylinders can be calculated.

In addition, the basic maps aforereferred to also contain an amount of fuel required for each cylinder for the sensed engine running conditions. This is in essence a basic fuel injection amount computation made in the section 185. This computation may be based either on fuel volume or duration of injection timing. Air flow volume and other factors may be employed to set the basic fuel injection amount.

The outputs from the engine speed calculation 183 and engine load or throttle position sensor 148 are also transmitted to a reference ignition timing computer 186 and a reference fuel injection computer 187. In addition to the outputs of the basic engine condition sensors (speed and load in the described embodiment) there are also other external factors which will determine the optimum basic fuel injection timing duration and ignition timing. These may include among the other things, the trim angle of the outboard motor as determined by the trim angle sensor 151 and the actual combustion temperature as indicated by a sensor indicated schematically at 188. Furthermore, the atmospheric or barometric pressure, all previously referred to also is significant and this is read, as aforenoted, by the sensor indicated schematically at 171 in FIGS. 12 and 13.

The outputs from these sensors 151, 188, and 171 are transmitted to an ignition timing compensation computer section 189 and a fuel injection amount compensating computer 191. These compensation factors are determined also based upon known value maps programmed into the ECU 99.

The outputs from the reference ignition timing computer 186 and the compensation value computer 189 are transmitted to an ignition timing compensating circuit 192. This then outputs a signal to the ignition timing per cylinder compensating circuit 193 which receives also signals from the unit 184 that sets the ignition timing for each cylinder. This then determines the appropriate timing for the ignition output from the driver circuit 194 for firing the individual spark plugs.

The crank angle detector 146 also is utilized to determine the appropriate ignition timing as is the output from a cylinder determination means, indicated generally by the reference numeral 195 and which determines, in a way which will be described, which individual cylinder is to be fired, depending upon the angular position of the crankshaft 53.

A similar system is employed for the fuel injection volume control. That is, a section 196 receives the reference fuel injection amount signal from the section 187 and the compensation amount from the section 191 and processes a corrected fuel injection amount. This is then transmitted to the section 197 which also receives the basic fuel injection amount per cylinder calculation from the section 185 to determine the corrected fuel injection amount per cylinder. This amount is then output to a fuel injector control circuit 198 which again receives the signals from the crank angle detector and cylinder determinator to supply the appropriate amounts of fuel to each cylinder by controlling the duration of opening of the fuel injector. Timing for the beginning of injection may also be controlled in a like manner.

The system also includes a cycle measuring arrangement 199 which determines the actual cycle of operation as will also be described later.

The basic control routine by which the actual fuel injection timing amount and ignition timing are determined will now be described beginning by reference to FIG. 14 and carrying on to those figures which follow it. As will become apparent, the basic concept operates primarily to set a basic fuel injection amount and timing determined by engine speed and load as aforenoted. Once the system is operating and the oxygen sensor 145 is at its operating temperature, the system shifts to a feedback control system. This feedback control system is superimposed upon the basic fuel injection amount and timing and spark timing so as to more quickly bring the engine to the desired running condition.

As has been noted, the output or combustion condition in one combustion chamber only is sensed and that signal is employed for controlling the other cylinders. In addition, there are some times when cylinders are disabled to reduce the speed of the engine for protection, as has also been noted. This system ensures proper control also during these times even if the disabled cylinder is the one with which the sensor is associated.

The control routine will now be described initially by reference to FIG. 14 with the discussion continuing onto the remaining figures where necessary. The program starts and goes to the step S11 where the system is initialized. The program then moves to the step S12 wherein the ECU 99 determines the operational mode. This operational mode may be of one of many types and is based upon primarily the results of the inputs from the sensors as shown in FIG. 12.

The available modes may include start-up mode when the engine is first started. As previously noted, there is a starter switch 177 and, when the starter switch has been initiated and the program has just begun, the ECU 99 will assume the starting mode and go into the appropriate control routine for that starting mode. This will employ neither feedback control nor necessarily sensing of engine running conditions, but rather set the appropriate parameters for engine starting and/or warm-up.

Another potential mode is the oxygen sensor feedback mode under which feedback control will be accomplished in the manner which will be described.

A further mode is the study or memory mode and this is the mode, as will also be described wherein the ECU and specifically the volatile memory 179 thereof receives data from engine running conditions and memorizes them for use under certain operating conditions, as will be described.

Another potential mode is the operation when a cylinder or more is being disabled to affect speed control and protection for a so-called "limp home" mode. This mode will also be described later by reference to the remaining figures and is based upon the sensing of other conditions which will now be also mentioned.

The disabling of cylinders to protect the engine may occur in response to the sensing of a number of critical features. One of these features is if the engine is operating at too high a speed or an over-rev condition. Another condition is if the engine temperature is too high or is approaching a high level where there may be a problem. Another feature, as has been noted, is if there is a low oil level in the oil reservoir 144. A still further condition is if there is a dual engine system and one of the engines experiences one of the aforenoted conditions and, thus, both engines will be slow even though one engine may not require this.

Having determined the operational mode at the step S12, the program moves to the step S13 to determine which of the two time programs or control loops are presently occurring. The system is provided with two separate control loops: loop 1, which repeats more frequently than the other loop (loop 2). The timing for loop 1 may be 4 milliseconds and the timing for loop 2 may be 8 milliseconds. These alternative control loops are utilized so as to minimize the memory requirements and loading on the ECU 99.

Assuming that the loop 1 mode has been determined at the step S13, the program moves to the step S14, first to read the output of certain switches. These switches may include the main engine stop or kill switch 178; the main switch for the entire circuit, which is not shown; or the starter switch 177. The purpose for reading these switches is to determine whether the engine is in the starting mode or in a stopping or stopped mode so as to provide information when returning to the step S12 to determine the proper control mode for the ECU 99 to execute.

Having read the switches at the step S14, the program moves to the step S15 so as to read certain engine switch conditions which may determine the necessary mode. These switches may include, for example, the output from the knock detector 172 and/or the output from the throttle position sensor 148.

If loop 1 is not being performed at the step S13 or if it and the steps S14 and S15 have been completed, the program moves to the step S16 to determine if the time has run so as to initiate the loop 2 control routine. If the time has not run, the program repeats back to the step S12.

If the system is operating in the loop 2 mode of determination, the program then moves to the step S17 to read the output from certain additional switches. These switches can constitute the lubricant level switch 173, the neutral detector switch 149 and the DES output switch 175 to determine if any of these specific control routines conditions are required. Having read the second series switches at S17, the program then moves to the step S18 to read the outputs from additional sensors to those read at the step S15. These sensors include the atmospheric air pressure sensor 171, the intake air temperature from the sensor 147, the trim angle from the trim angle sensor 151, the engine temperature from the engine temperature sensor 169 and the battery voltage from the battery sensor 176.

The program then moves to the step S19 to determine if cylinder firing disabling is required from the outputs of the sensors already taken at the steps S17 and/or S18. The program then moves to the step S20 so as to provide the necessary fuel pump and oil pump control.

The program then moves to the step S21 to determine if the system should be operating under normal control or misfire control. If no misfire control is required because none of the engine protection conditions are required, then the program moves to the step S22 to determine from the basic map the computation of the ignition timing, injection timing and amount of injection per cylinder. As has been previously noted, this may be determined from engine speed and engine load with engine load being determined by throttle valve position. This basic map is contained in the nonvolatile memory 181 of the ECU 99 as previously noted.

If at the step S21 it is determined that the program requires misfire or speed control by eliminating the firing of one cylinder, the program moves to the step S23 to determine from a further map referred to as a disabled cylinder map the ignition timing and injection timing and duration. This map is also programmed into the nonvolatile memory 181 of the ECU 99 from predetermined data and is based upon the fact that the engine will be running on a lesser than total number of cylinders.

Once the basic ignition timing and injection timing and amount are determined at the appropriate steps S22 or S23, the program then moves to the step S24 so as to compute certain compensation factors for ignition and/or injection timing. These compensations are the same as those compensations which have been indicated as being made at the sections 192 and 193 and 196 and 197 of FIG. 13.

These compensation factors may include such outputs as the altitude pressure compensation, trim angle compensation and engine temperature compensation determined by the outputs from the sensors 171, 151, and 169, respectively. In addition, there may be compensation for invalid injection time and ignition delay made at the step S24.

The program then moves to the step S25 to determine if the engine is operating under oxygen feedback control and to make the necessary feedback control compensations based upon the output of the oxygen sensor 145. The ways in which this is done will be described later and this may include the learning curve which will also be described.

The program then moves to the step S26 to determine if the output from the knock sensor 172 requires knock control compensation which may include either adjustments of spark timing and/or fuel injection amount. The program then moves to the step S27 so as to determine the final ignition timing injection timing and amount.

If, from the switch reading it is determined that the engine stop mode, the program moves to the step S27.5 where the engine stop procedure is initiated. At this step ignition is stopped and fuel injection is continued briefly. This insures the presence of fuel in the crankcase chamber 72 to assist restarting.

Another phase of the control routine will now be described by reference to FIG. 15. This phase has to do with the timing information primarily and certain procedure associated with the cylinder disabling mode for engine speed reduction and protection. The program begins when the timing sensor 146 indicates that the crankshaft is at top dead center. The program then moves to the step S28 to determine which cylinder it is that is at top dead center. This is done by utilizing the outputs of the cylinder position detectors 168.

The program then moves to the step S29 to ascertain from the order of approach of the cylinders to top dead center whether the engine is rotating in a forward or a reverse direction. It should be noted that, particularly on start-up, there is a possibility that the engine may actually begin to run in a reverse direction. This is a characteristic which is peculiar to two-cycle engines because of their inherent cycle operation.

If at the step S29 it is determined that the engine is rotating in a reverse direction, the program moves to the step S30 so as to initiate engine stopping. This may be done by ceasing the ignition and/or discontinuing the supply of fuel.

If at the step S29, however, it has been determined that the engine is rotating in the proper, forward direction, the program moves to the step S31 to measure the cycle of operation of the engine and then to the step S32 so as to actually compute the engine speed from the number of pulses from the crank position sensor 146 in relation to time, as previously noted. The program moves to the step S33 to determine if the engine speed is more than a predetermined speed. If the engine speed is too low, the program again proceeds to the step S30 where the engine is stopped.

If the engine continues to be operated, the program moves the step S34 to determine if the immediately detected cylinder is cylinder number 1. As has been noted, cylinder number 1 is the cylinder with which the oxygen sensor 145 is associated. If the cylinder number 1 has not been the one that is detected, the program skips ahead to the point which will be discussed below.

If, however, it is determined at the step S34 that cylinder number 1 is the cylinder that is being immediately sensed, the program then moves to the step S35 to determine if the engine is operating in a cylinder disabling mode. If it is not, the program moves to the step S36 so as to clear the register of the disabling information because the engine is now operating under a normal condition.

If, however, at the step S35 it is determined that the system is operating in the disabled cylinder mode so as to reduce or control maximum engine speed, the program moves to the step S37 to determine if the pattern by which the cylinder is disabled should be changed. As has been previously referred to, if the engine is being operated with one or more cylinders disabled so as to limit engine speed for the limp home mode, it is desirable to only disable a given cylinder for a predetermined number of cycles. If the disabling is extended, then on returning to normal operation the spark plug in the disabled cylinder may be fowled and normal operation will not be possible or will be very rough.

Thus, at the step S37 it is determined that the cylinder disabled has been disabled for a time period where it should be returned to operation, the program moves to the step S38. In the step S38, the disabling of the cylinder is switched from one cylinder to another in accordance with a desired pattern.

If it is not time to change the disabled cylinder at the step S37 or if the disabled cylinder number is changed at the step S38, the program then moves to the step S39 so as to set up or update the information as to the cylinder which is being disabled and the ignition disabling for that cylinder. The program then moves to the step S40 so as to actually step up the ignition pulse for the disabled cylinder and ensure that the cylinder will not fire. The program then moves to the step S41 so as to also ensure that the disabled cylinder will not receive fuel from the fuel injection. Then at the step S42, the disabling of injection pulse for the cylinder is also initiated. The program then moves to return.

Figure 15:
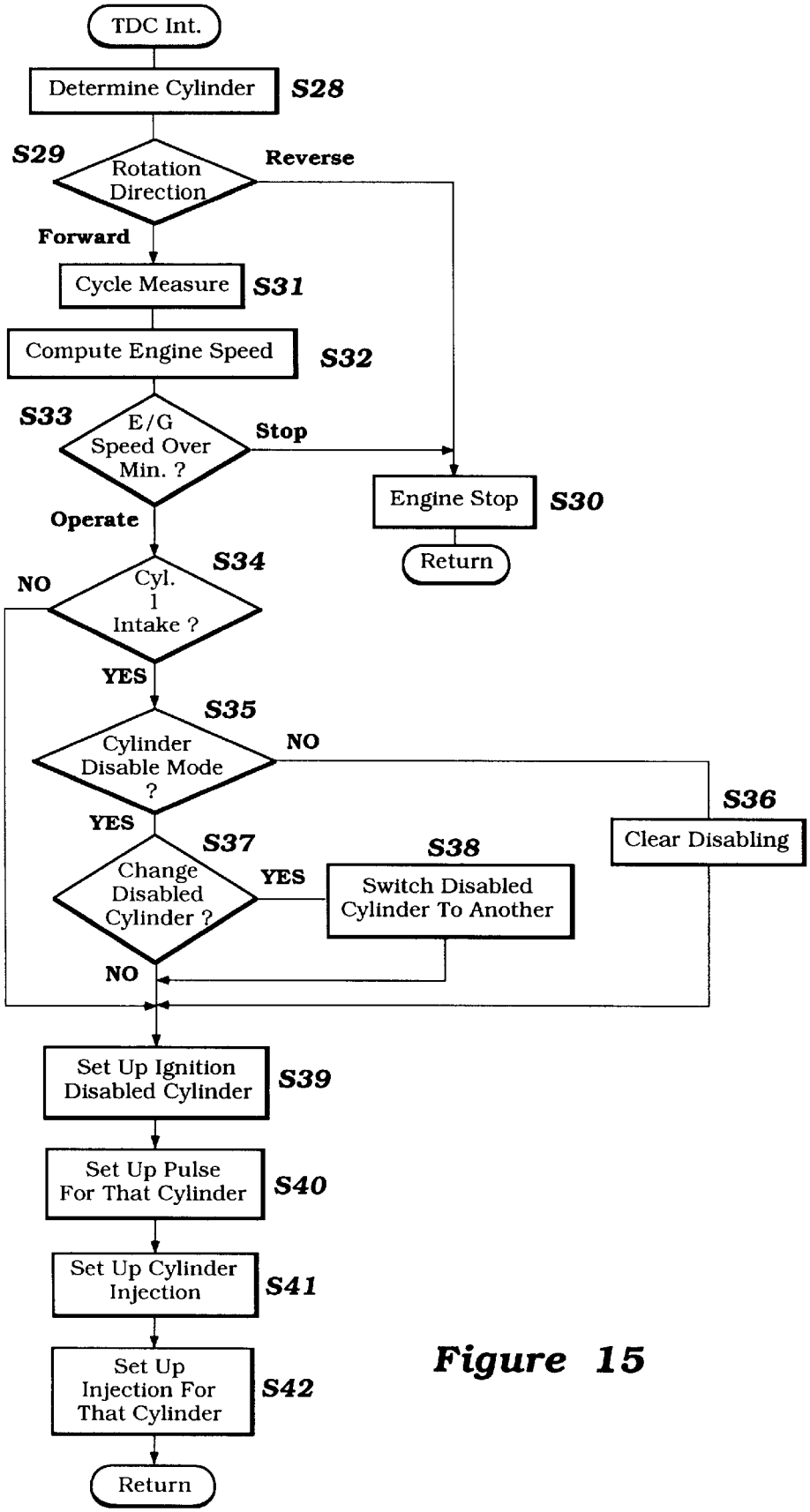
FIG. 15 is a further block diagram showing a further portion of the control routine including the condition when one cylinder is disabled to control the engine speed.
Figure 16:
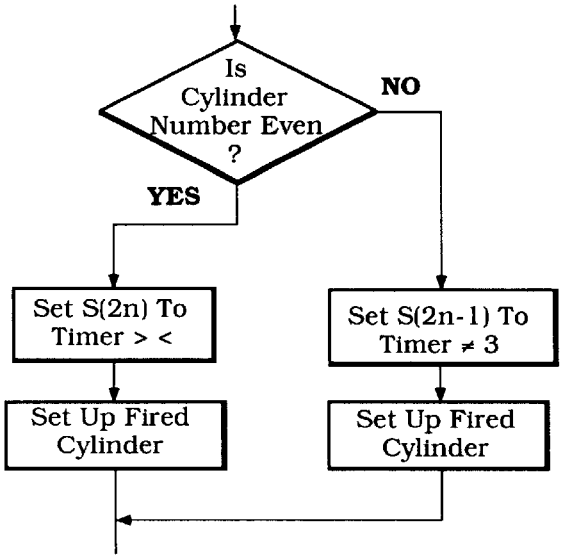
FIG. 16 is a block diagram showing a further portion of the control routine shown in FIG. 15 in sensing the respective cylinders.

FIG. 16 is a detailed subroutine that shows how the ignition pulse for the disabled cylinder at the step S40 in FIG. 15 is determined. In order to minimize the memory requirements and to permit faster computer operation, the system is provided with two timers, one associated with those cylinder numbers that are even, and one that is associated with those cylinder numbers that are odd (Timers #3 and #4). This cylinder number is based upon the firing order which may not necessarily be the same as the way the cylinders are numbered in FIGS. 3 and 7. However, in those figures the firing order is determined to be the same as the way the cylinders are numbered. Regardless of the way the cylinders are numbered, those skilled in the art will understand the advantages of using the two timers rather than a single timer. In the specific example of FIGS. 1–5, the engine is a V-6, as has been noted, and, therefore, the firing of the cylinders is at an equal 60° angle. The cylinders in one bank are even numbered while those in the other bank are odd numbered.

Timer number 3 is utilized for odd-numbered cylinders while timer number 4 is used for even-numbered cylinders. Hence, when the program initially begins to set up the ignition pulse for the cylinder at the step S4, it is determined at the initial step if the cylinder number to be controlled is an even number or an odd number. If it is an odd number, the program moves to the right-hand side so as to set the timer for cylinder number 3 to be equivalent to the determine cylinder times 2 minus 1, that is, S is (2n−1) for the timer. From this, then the timing for the next cylinder number on the odd sequence is set from this information.

On the other hand, if the cylinder number is even, the timer number 4 is utilized and the timing for the next cylinder is set as 2n. The program then moves to the next step so as to set up the appropriate ignition timing for this.

Figure 17:
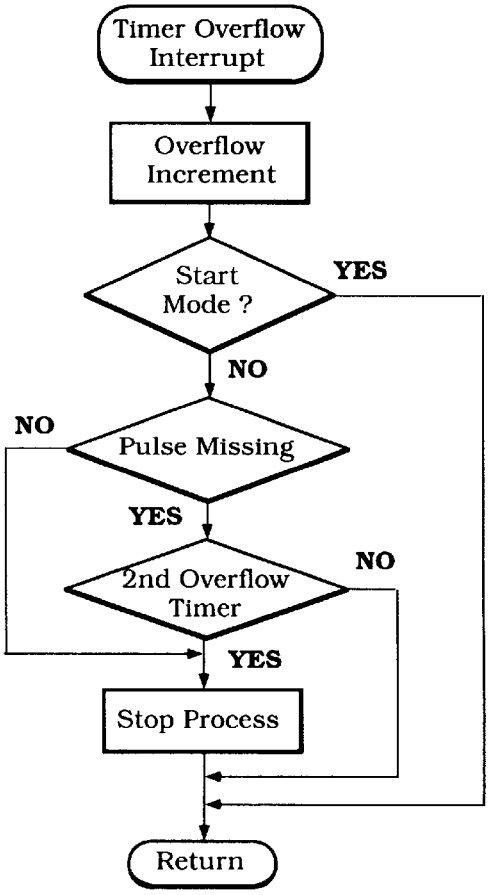
FIG. 17 is a block diagram showing a portion of the control for shut down utilized in FIG. 15.

FIG. 17 shows a control routine that is employed so as to stop the engine if the engine is running too slow. This is an explanation of the control routine which takes place basically in steps S31–S33 of FIG. 15.

If the engine is permitted to run at a speed that is too slow, the plugs will eventually foul and the engine will stall. If the engine is permitted to continue to run until its stalls, then restarting or resumption to normal operation will be difficult. Therefore, when the ECU 99 determines by the control routine of FIG. 17 that the engine is running too slow and fouling will occur to cause stalling, the engine is shut down before that occurs.

There is, therefore, set a timer which counts the time between successive ignition pulses. And thus, at the first step in this figure, the timer overflow interruption is set and in the next step it is determined if the time between successive pulses is excessive because of an overflow of the timer then the program moves to a step to determine if the engine is in the original starting mode.

The reason it is determined if the engine is in original starting mode is that during initial engine starting the speed of the engine will be lower than the normal stalling speed at least initially. Thus, it is desirable not to effect stopping of the engine if the engine is in the original start-up mode because the engine would never be started otherwise. Thus, if it is determined at the start mode step of FIG. 17 that the engine is in the starting mode, the program jumps to the return.

If, however, it is determined that the engine is not in a starting mode, then the program moves to the next step to determine if a pulse has been missed. If a pulse has not been missed, as would be the case if there was a cylinder disabling for reducing the speed, then it is determined that the time interval is too long and the program immediately jumps to the step where the stopping process of the engine is initiated. Engine stopping is accomplished by discontinuing the firing of the ignition for all cylinders and/or the supply of fuel to all cylinders.

If, however, a pulse has been missed it may be because of the fact that the next successive cylinder is one which is not being fired in any event. Then the program moves to another step where the time between pulses is determined to be twice the normal pulse interval so as to accommodate a skipped cylinder. Thus, if the firing between two cylinders exceeds the time interval between 120° plus a time factor at this step, then it is assumed that the engine is running too slow and the program again initiates the stop process so as to stop running the engine and prevent plug following.

Figure 18:
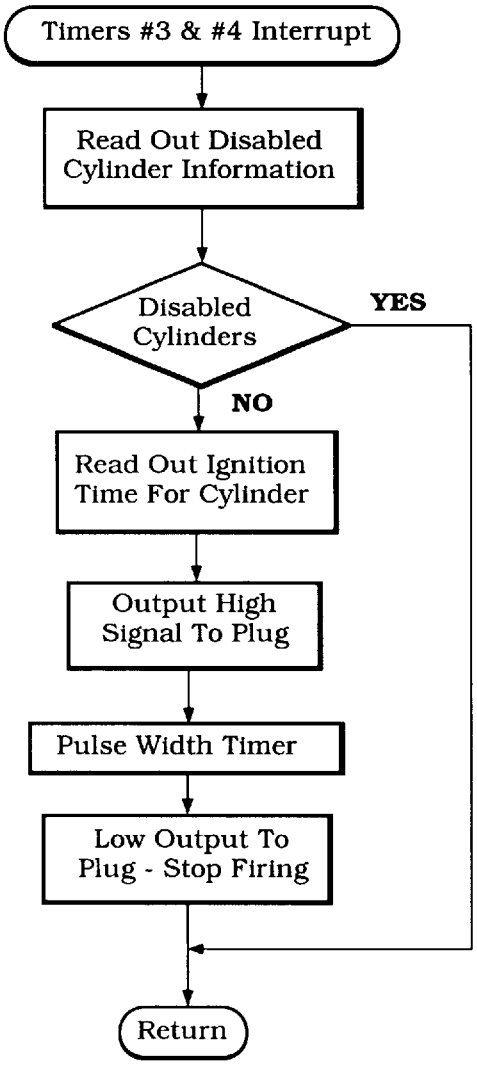
FIG. 18 is a block diagram showing more details of the control routine during cylinder disabling.

FIG. 18 shows the arrangement for controlling the condition when cylinders are disabled. This program starts out by reading the interruption phases from the pulses of the individual cylinders at timers #3 and #4. The program then moves to the next step to read out the disabled cylinder information and identify the cylinder which is being disabled.

The program then moves to the next step to see if the cylinder in question is the cylinder which is being disabled. If so, the program moves to return. If, on the other hand, the cylinder is not a disabled cylinder, then the program moves to the step to read the ignition output for that cylinder and determine the timing interval.

The program then moves to the next step to output a high pulse to the spark coil for that cylinder to effect its sparking.

The program then moves to the next step to set the pulse width timer for the duration of the plug firing, and finally to the step when the ignition output port is returned to the low value and ignition is discontinued.

Having thus described the general routine by which the ECU 99 controls the engine and specifically the fuel injec-tion and spark timing, the way in which the output of the oxygen sensor 145 is employed for the various feedback control routines and when feedback control is used and when it is not used will now be described by reference to the remaining figures beginning primarily with FIG. 19.

Figure 19A:
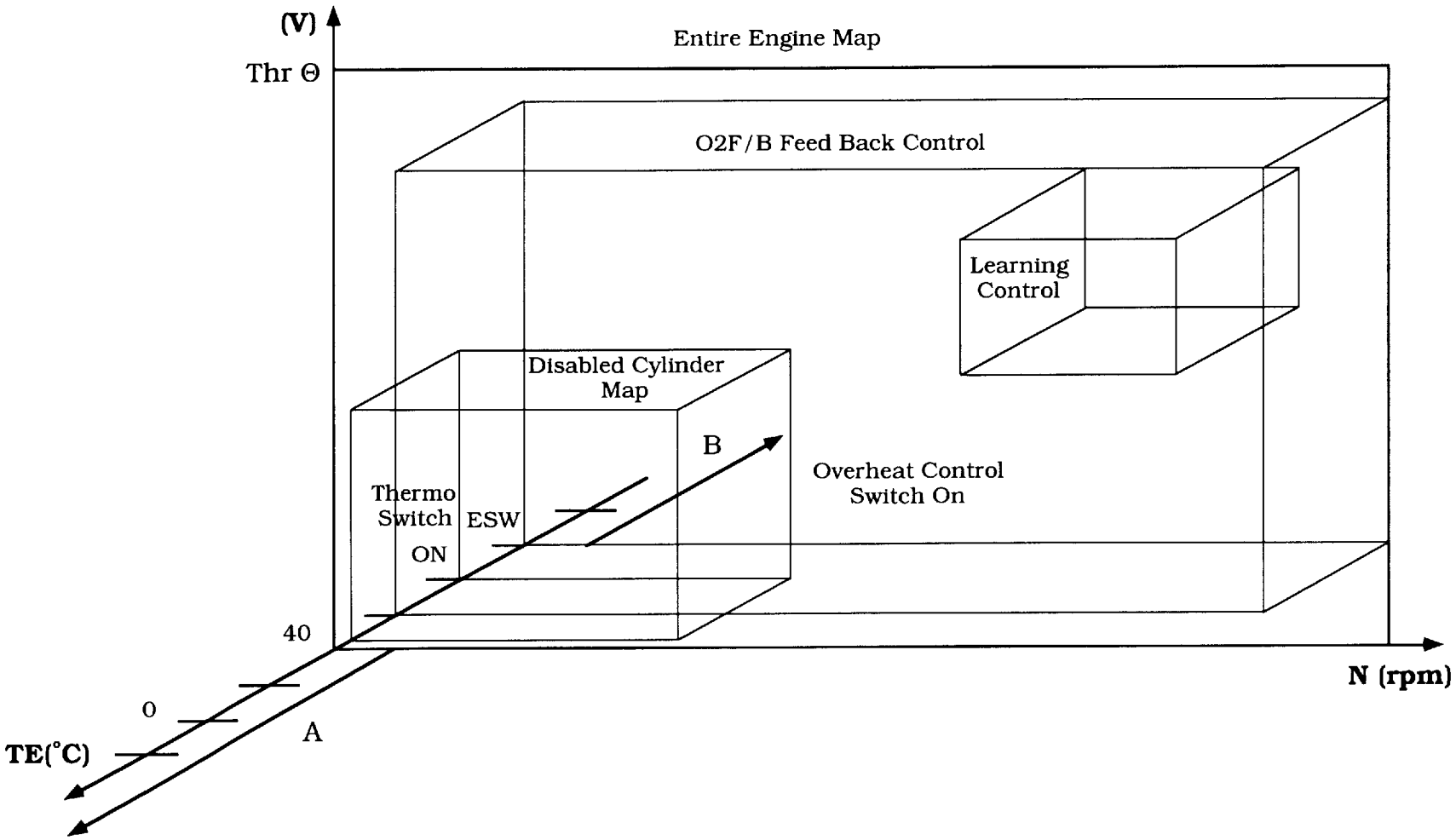
FIG. 19*a* is a three dimensional map showing control ranges for the engine.

FIG. 19*a* is a three-dimensional control map showing various of the control phases for the entire engine operation. This map is based upon three factors these being engine speed N and load determined by throttle valve opening V. In addition to these parameters, engine temperature TE also is factored in, as should be apparent from the aforedescribed background discussion.

As has been previously noted, there is a feedback control range which exists when the engine temperature and specifically the oxygen sensor temperature is sufficient so as to provide reliable information by which feedback control may be enjoyed. In addition, there is a further map which has been referred to which is the control range wherein the engine is operating with a disabled cylinder or cylinders for the limp home mode. This is based primarily on the range when the thermoswitch is on indicating that there is an overheat situation. This may also occur when there is low oil level or the other conditions noted.

There is also a range indicated by the arrow A when the engine temperature is low and an open control must be employed.

Figure 19B:
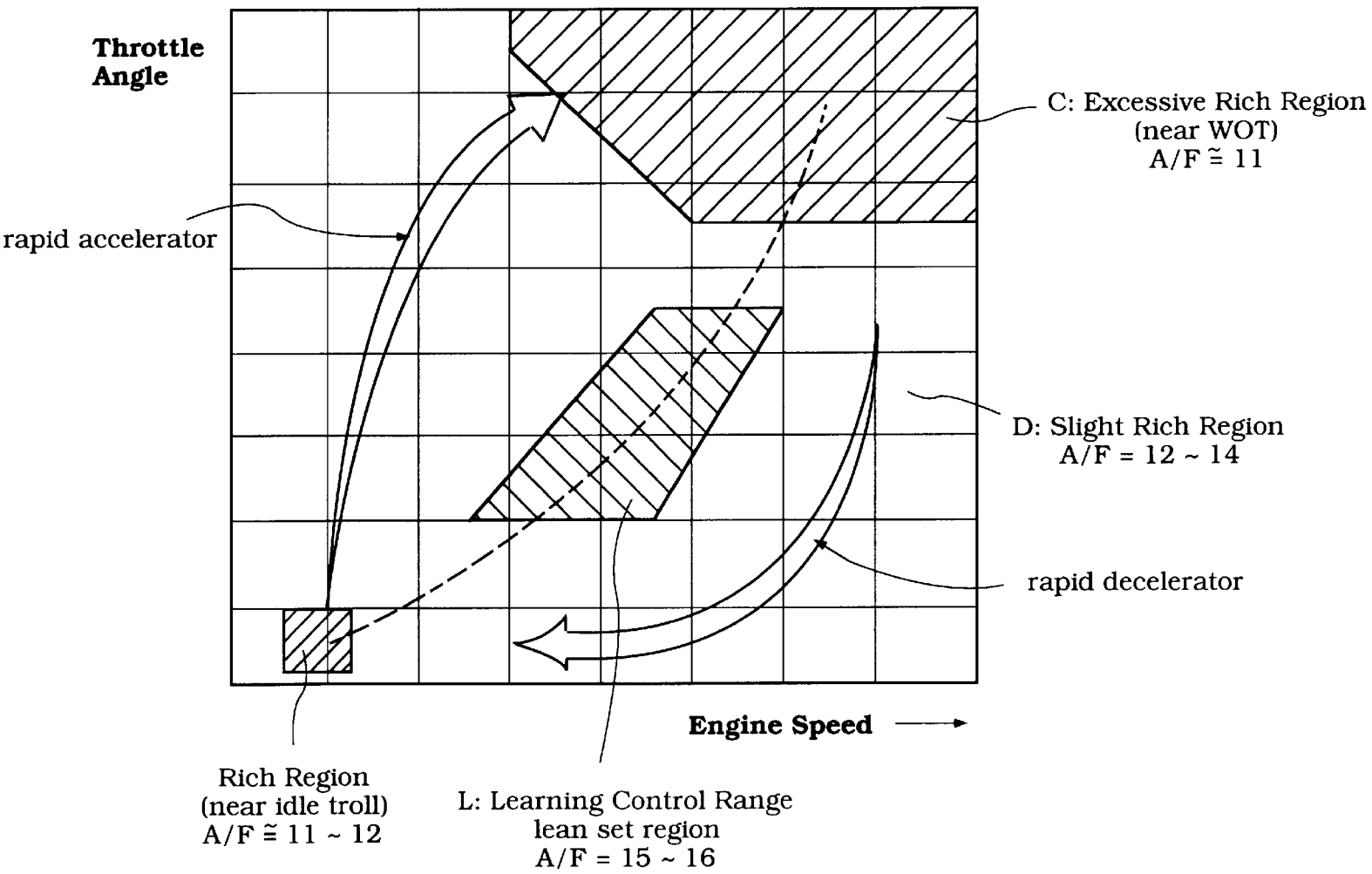
FIG. 19*b* is a diagram illustrating the learning control range for the engine as related to air/fuel ratio and engine speed.

Finally, as shown in FIG. 19*b*, there is the learning control range L where information is derived from the performance of the engine so as to permit generation of a map in the volatile memory 179 that can be employed for control either when the cylinder with which the oxygen sensor 145 is disabled or under other circumstances. As illustrated therein, the learning control range occurs at a mid-range engine rotational velocity and throttle position and when the air/fuel charge supplied the engine has an air/fuel ratio which is slightly lean, preferably being about 15 or 16 to 1.

Figure 20:
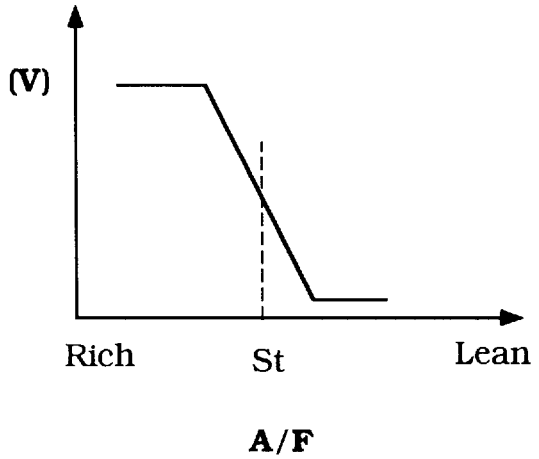
FIG. 20 is a block diagram showing the output signal from the sensor in relation to air/fuel ratio and output voltage.

The feedback control strategy will be described initially by reference to FIGS. 20–22 and then further by reference to FIG. 23. Referring first to FIG. 20, this is a graphical view showing the voltage "V" output of the oxygen sensor 145 in relationship to air/fuel ratio. The stoichiometric point is shown by the vertical dotted line St which is approximately 14.7 to 1 air/fuel ratio. It will be seen that the sensor 145 is of the type that outputs a high voltage signal when the mixture is richer than stoichiometric and a low voltage signal when the mixture is leaner than stoichiometric.

Figure 21:
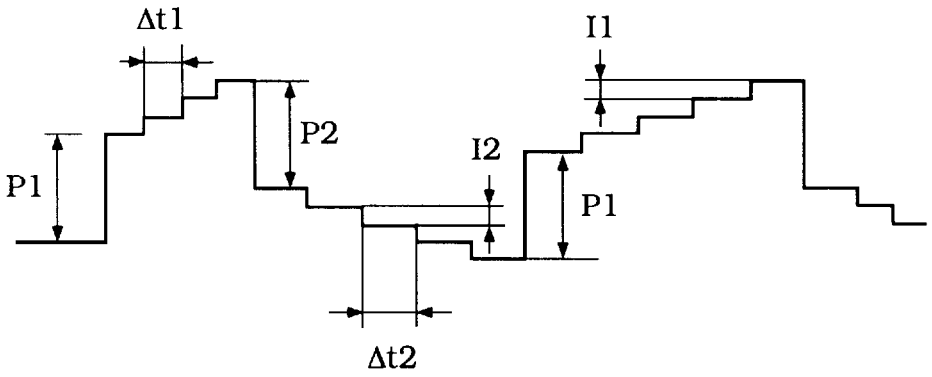
FIG. 21 is a block diagram showing the control routine during a feedback control mode.

The control strategy is depicted in FIG. 21 which shows a number of variable factors that are utilized in the control strategy. Beginning at the left of the time line in FIG. 21, it will be seen that when the mixture is leaner than stoichiometric the control strategy is first to provide a rich proportional fixed incremental increase in fuel injection amount in the amount indicated at P1. This value of P1 is varied in accordance with a map, as shown in FIG. 22 depending upon engine speed. Once the initial proportional P1 adjustment is made, then the program waits a first time interval Δt1 before further incremental adjustments toward the rich side are made. This time t1 is set to be shorter before the stoichiometric or crossover point is reached for the first cycle than after. Upon subsequent readings after convergence a longer time interval Δt2 is applied for the subsequent adjustments. The time intervals Δt1 and Δt2 are also derived from a map, as seen in FIG. 22.

When going from rich to lean the incremental steps I1 are employed, this being the rich integral constant increase. This value is also derived from a map (FIG. 22).

Once the stoichiometric point is crossed and the mixture then calls for lean adjustments, there is an initial lean proportional step P2 made and then after successive time intervals Δt2 a lean integral constant I2 is employed for subsequent steps.

Figure 23:
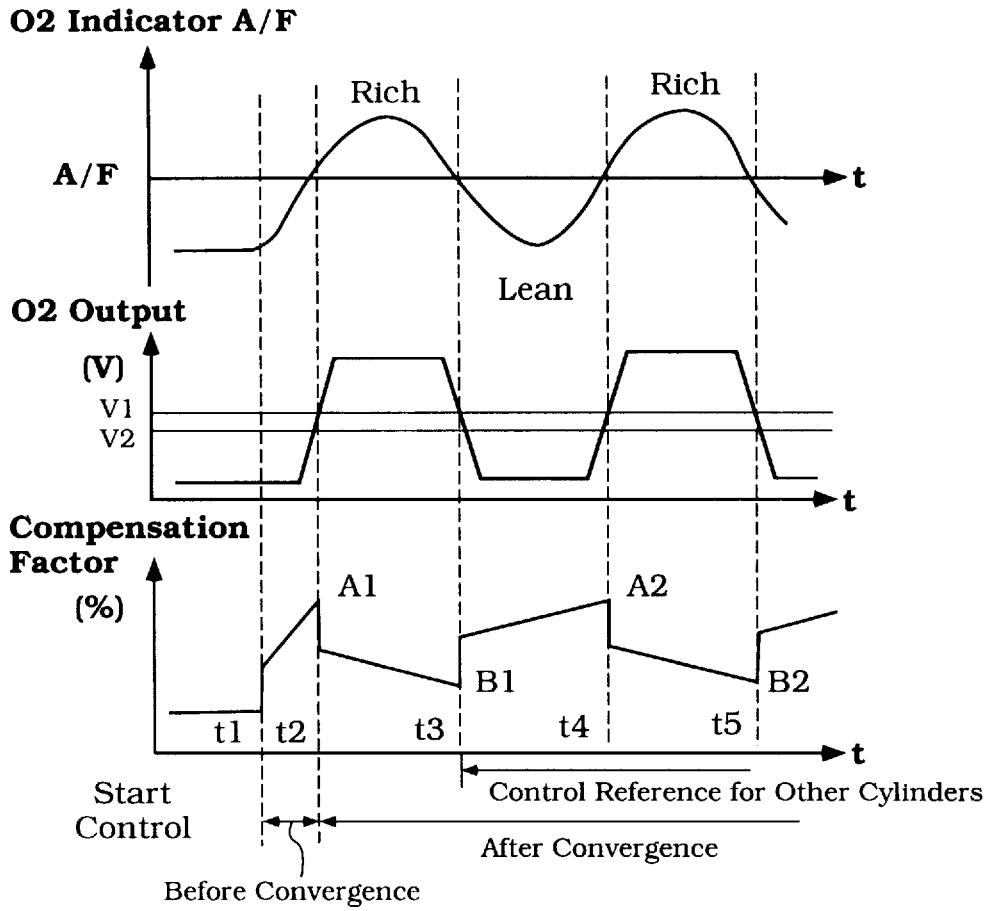
FIG. 23 is a graphical view showing a condition during feedback control and the outputs and the target air/fuel ratio, oxygen sensor output, compensating factor and the compensation factor utilized for the various cylinders.

Referring now to FIG. 23 it will be seen that there are two voltage signals V1 and V2 which are employed to determine when transitioning from rich to lean and lean to rich, respectively. These voltage points V1 and V2 also are varied in accordance with a map in relation to engine speed but V1 generally is higher than V2.

Referring now specifically to FIG. 23, it will be seen that when the engine is originally started and before the engine or more specifically the oxygen sensor 145 is at its operating temperature, this being the range indicated at A in FIG. 19, that there is an open control based upon a preset map or control strategy.

At the time t1 the oxygen sensor will begin to reach its operating temperature and will output a signal. However, the engine is basically run on the lean side during initial startup and when there is a switch-over to the feedback control the fuel amount will be increased by the amount P1 at the time t1. This fuel increase will then be continued to occur in the steps I1 along the slope shown in FIG. 23 until the time t2. The time t2 is when the oxygen sensor output reaches the value V1 and the mixture tends to go across the stoichiometric point from lean to rich as indicated in the upper portion of the curve.

The time t2 is the time which is referred to as initial convergence and this is the first time that the sensor output indicates that a stoichiometric condition has been reached. In accordance with the control strategy as will be further described later, the actual control for the other cylinders at this time is not made based upon the output from the oxygen sensor 145. Hence, although cylinder #1 is controlled during this stage by the feedback control, the remaining cylinders are operated under an open control condition or from previously memorized values.

As may be seen, when the oxygen sensor 145 crosses the reference voltage V1 and the mixture goes rich, then the feedback control for cylinder 1 is initiated so as to decrease the amount of fuel supplied in accordance with the lean proportional amount P2 as shown by the step that occurs from the value A1. The value A1 may be determined to be the value of the amount of fuel supplied over and above the normal base amount to achieve stoichiometric at feedback control conditions.

After the initial fuel reduction in the amount P2 then additional reductions are made now at the time period Δt2 in the amount I2.

At the time period t3 the mixture will have been lean sufficiently so that the oxygen sensor output will cross the lean threshold value V2 and at this time a fuel supply amount B1 is noted which then forms a basis for the control reference value for controlling the other cylinders. Hence, the control reference signal is taken after the second convergence of the output of the oxygen sensor with the stoichiometric line and this value is utilized for subsequently controlling the other cylinders, as will now become apparent by reference to the additional remaining figures.

Figure 14:
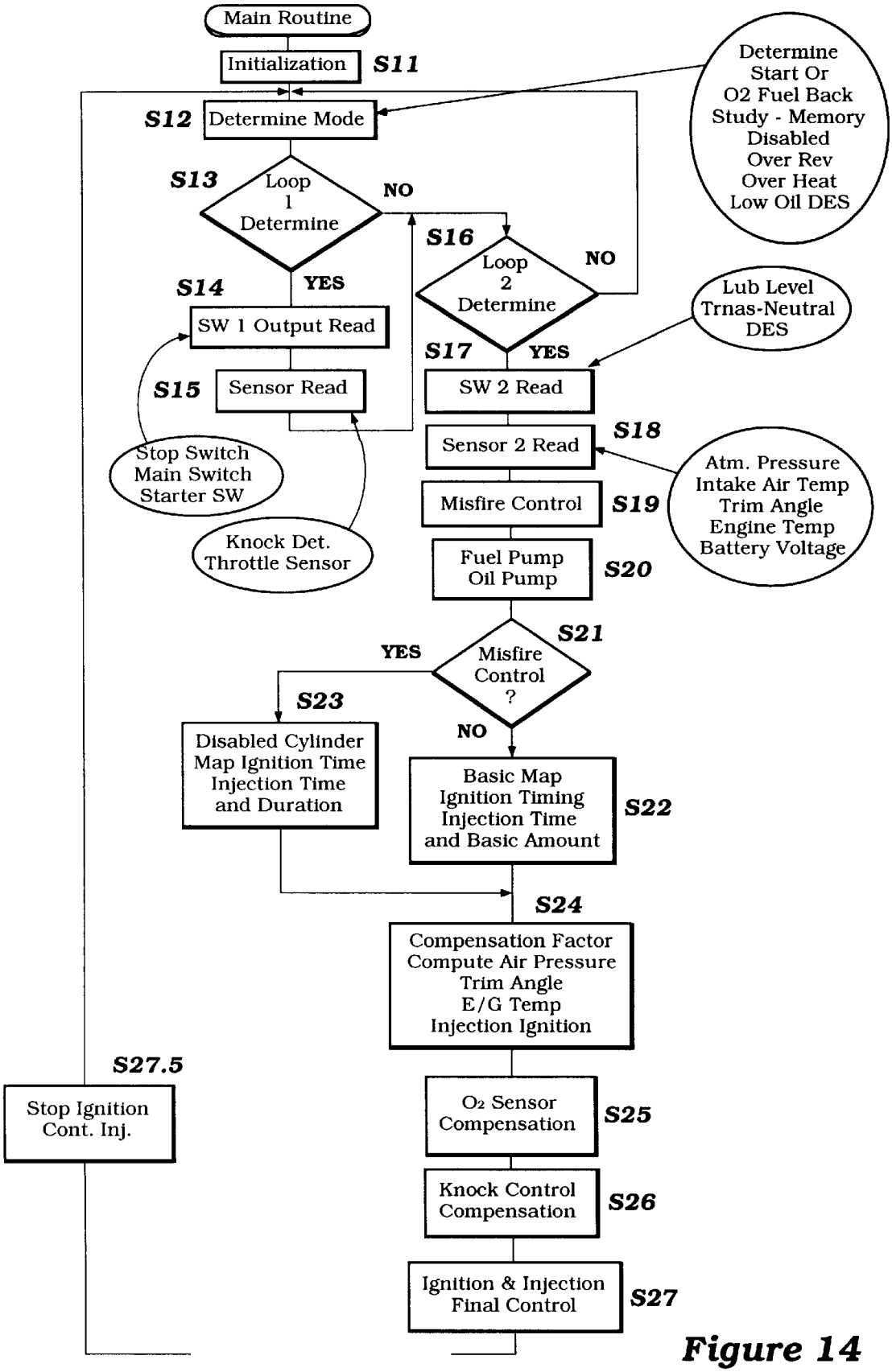
FIG. 14 is a block diagram showing the main portion of the control routine wherein the system provides the control depending upon whether or not a cylinder is disabled to slow the engine speed because of an encountered abnormality that could cause engine damage if not controlled.
Figure 24:
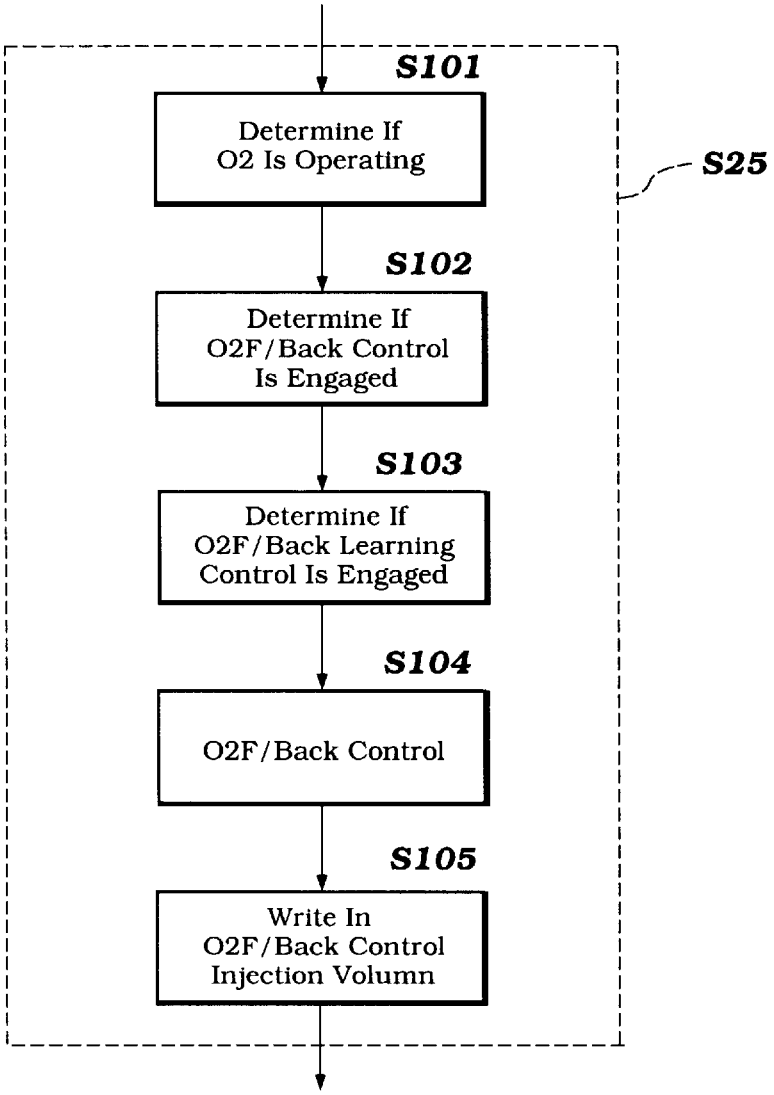
FIG. 24 is a block diagram showing the learning process for obtaining the control and the selection of the type of control.

Referring now to FIG. 24, this is a view which shows in more detail the routine followed at the step S25 of FIG. 14 wherein the oxygen sensor output is utilized so as to provide compensation for the control of the detected cylinder, i.e., cylinder #1, and the other cylinders. As seen in this figure, the program starts at a step S101 to determine whether the oxygen sensor 145 is at its operating temperature and whether it can be utilized for feedback control. This may be determined by any type of routine.

The program then moves to the step S102 which in effect makes reference to FIG. 19 to determine if the engine condition is such that feedback control can be employed.

The program then moves to the step S103 if the condition is such that the feedback control learning routine as shown in FIG. 19*b* (i.e., mid-range engine speed and throttle setting, an air/fuel between about 15 and 16 to 1), and which will be described later will be employed. The determination is made in accordance with the routine shown in FIG. 31.

The program then moves to the step S104 to initiate the operation of feedback control. The control involves learning the injection time interval in accordance with the routine shown in FIG. 32.

The program then moves to the step S105 so as to write in the feedback control injection volume which has been learned. This will be described in more detail by reference to FIG. 25.

Figure 25:
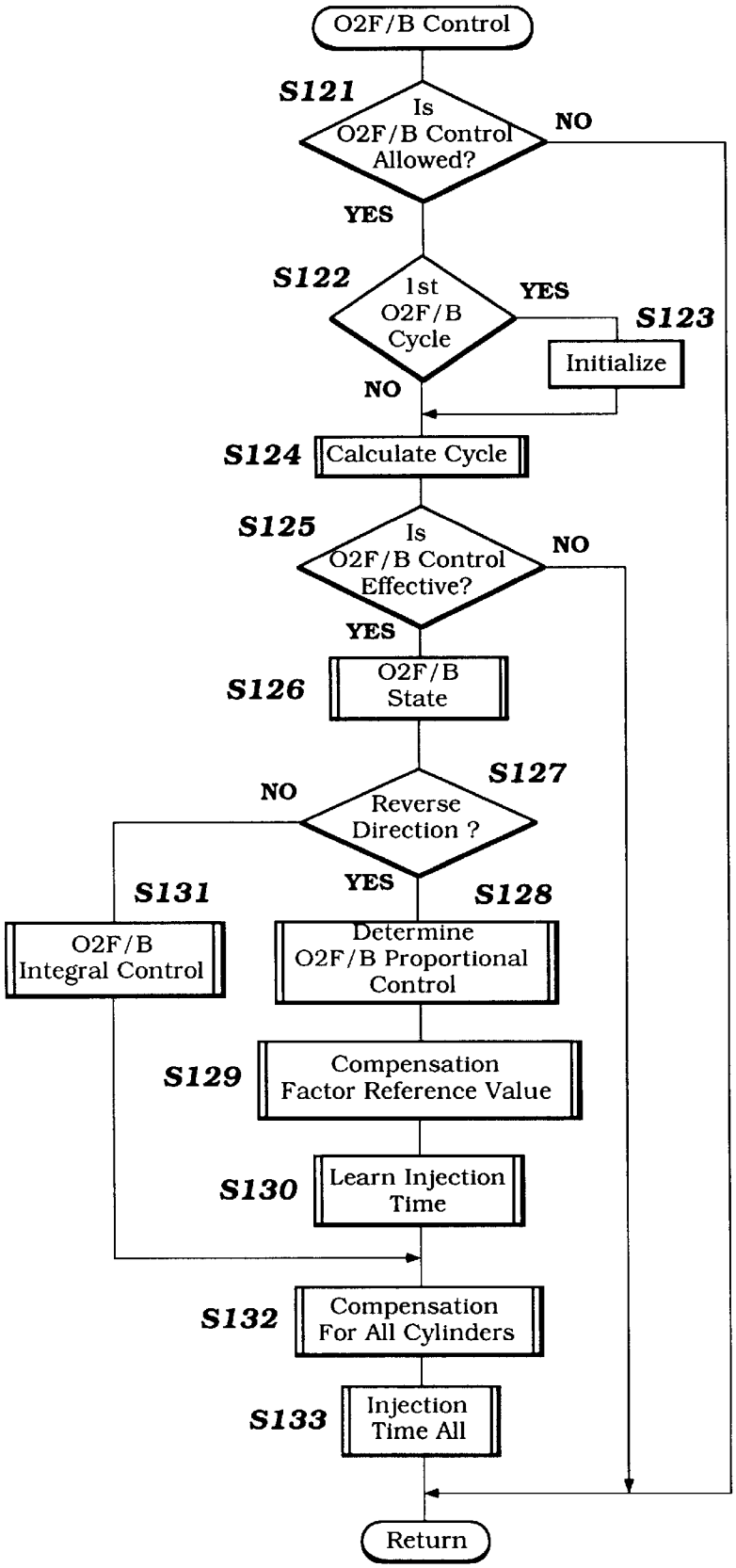
FIG. 25 is a block diagram showing more details of a portion of the control routine utilized in FIG. 24 in connection with another feature.

Referring now to FIG. 25, this figure shows in detail the procedure followed in the step S104 of FIG. 24 so as to provide the feedback control by the oxygen sensor. The program moves to the step S121 so as to first determine from the map of FIG. 19*a* if the engine condition is such that feedback control is permissible. If not, the program jumps to the return.

Figure 26:
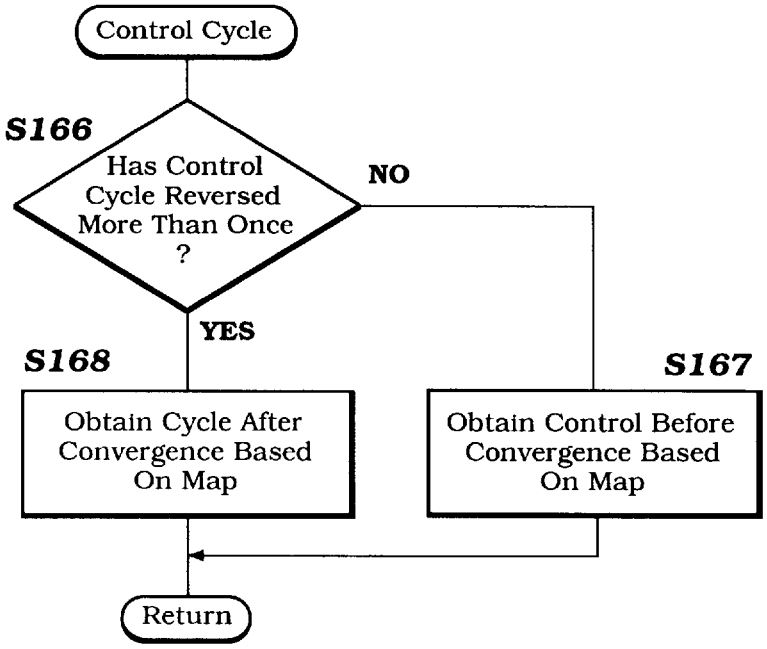
FIG. 26 is a block diagram showing another phase of the control to obtain the control utilized in the routine of FIG. 25.

If, however, at the step S121 it is determined that feedback control is permissible, then in the condition that this is the first range of feedback control, that is, the first cycle before there has been convergence. This would be equivalent to the time period t1 to t2 in FIG. 23. If the program is in this first stage of feedback control, the program then moves to the step S123 so as to initialize the variable values. If, however, at the step S122 it has been determined that the cycle is not the first feedback control cycle, then the program moves to the step S124 so as to calculate the actual feedback control cycle. This is done as will be described later by reference to FIG. 26.

The program then moves to the step S125 to determine if the system is such that it is in a feedback control mode. That is, this will determine if there is actually an adjustment in the fuel amount being made. If it is not, the program skips to repeat.

Figure 27:
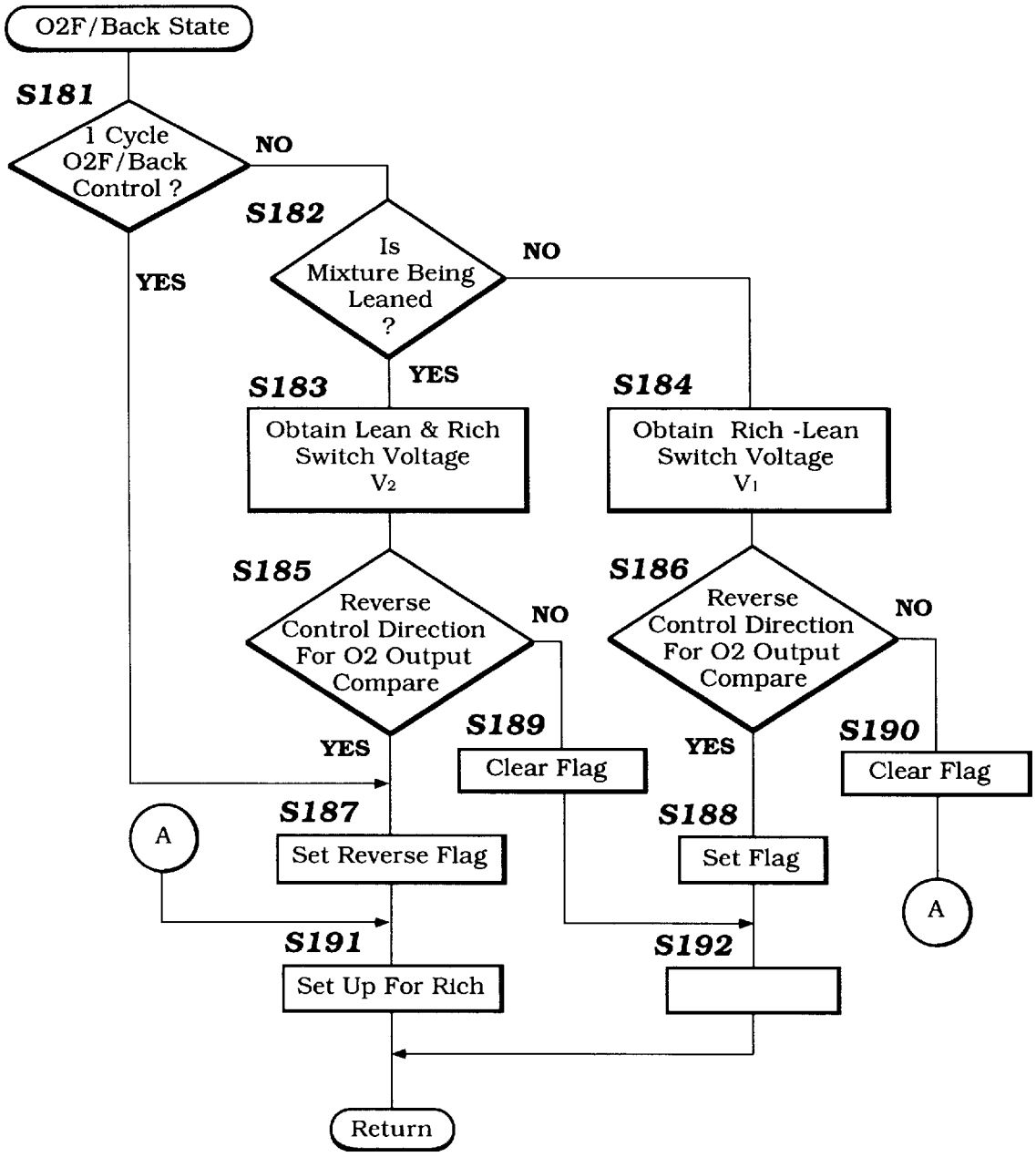
FIG. 27 is a further block diagram depicting yet another portion of the control routine utilized in the routine of FIG. 25.

If, however, at step S125 it is known that there is a feedback control being effected, then the program moves to the step S126 to determine the direction in which the control is being made; that is, is the feedback control being made in a direction to increase the amount of fuel supplied or to decrease the amount of fuel supplied. This will be described in more detail later by reference to FIG. 27.

The program then moves to the step S127 to compare the result of the step S126 with the previously noted method of direction of adjustment to determine if the crossover point is being reached so that the mixture is being switched from the rich side to the lean side or from the lean side to the rich side.

If at the step S127 it is determined that there has been a reversal or crossover, then the program moves to the step S128 so as to calculate the value of the respective proportional constant P1 or P2, depending upon the direction in which adjustment is being made. As previously noted, this is determined by the engine speed in accordance with FIG. 22 and the appropriate map in the ECU 99.

The program then moves to the step S129 so as to determine the compensation factor reference value, either the amount I1 or I2, again depending upon whether the adjustment is being made in the rich or lean direction.

The program then moves to the step S130 so as to learn or memorize the injection time from these values for the cylinder. This will be described later by reference to FIG. 29. That is, this information is placed into the volatile memory.

Figure 22:
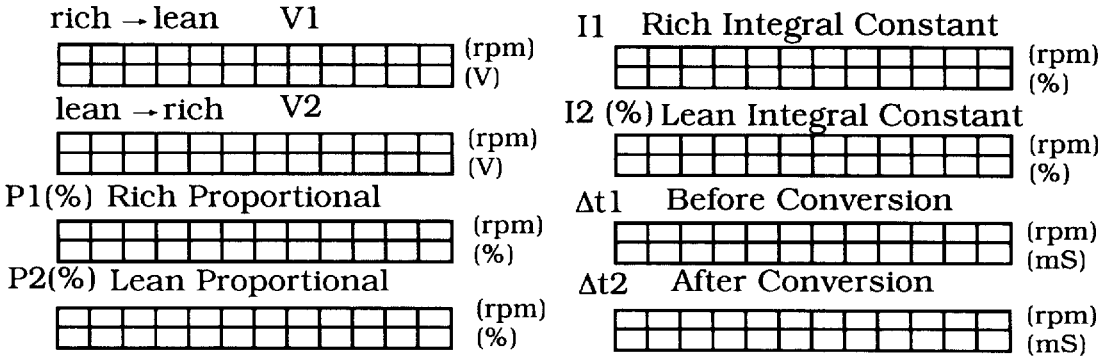
FIG. 22 is a block diagram showing the map and method for determining the constants and parameters for the feed back control system.

If at the step S127 it has been determined that the direction of compensation is being reversed, then the program moves to the step S131 to determine the integral constant for the appropriate direction, either I1 or I2, again from FIG. 22. This also is done in relation to the actual engine speed at the time.

Thus, from either the step S130 or the step S131, the program then moves to the step S132 wherein the compensation factor for all cylinders based upon the feedback control value at the crossover point is determined. The program then moves to the step S133 so as to determine the injection time for all cylinders and then returns.

In referring to FIG. 25, and specifically step S124 thereof, it was noted that the cycle of operation was calculated at the step S124. This method will now be described in conjunction with FIG. 26, which is in fact a subroutine step which takes place in step S124. At the step S166 it is determined whether the control cycle direction has reversed once or more than once. Referring back to FIG. 23, it will be seen that this determination then is decided whether the program is in the phase between t2 and t3, or after t3. Hence, this determination is made at the step S166.

If the reversal has only been once, then the program goes to the step S167 wherein the control cycle before convergence is based upon a map of the engine speed and load. If, however, the control cycle has reversed at least once, then the control is based again on the map at the step S168 after the convergence.

It has also been noted that at the step S126 of FIG. 25 there is a determination made as to the state of the feedback control. This will be described in more detail by reference to FIG. 27, which is a subroutine showing how this determination is made. When the program starts this subroutine step, it moves to the step S181, wherein it is determined if this is the first cycle of feedback control. Obviously, at the first cycle of control it will not be possible to determine if the control is in the lean direction or the rich direction. Although the example shown in FIG. 23 assumes that the engine was running lean before feedback control began, this may not always be the case. Thus, if the first cycle of feedback control exists, the program skips ahead to an advanced step, as will be described later.

If, however, at the step S181 it is determined that it is not the first cycle of operation, then the program moves to the step S182 to determine if the feedback control is leaning the mixture. If it is, then the program moves to the step S183 so as to obtain the lean-to-rich voltage switching value V2 from the table in FIG. 22 dependent upon the engine speed. If at the step S182 the mixture is not being leaned, then the program moves to the step S184 to obtain the rich-to-lean switch voltage B1 from the table of FIG. 22 in response to the engine speed.

Once the steps S183 and/or S184 have been performed, the programs then move to the steps S185 or S186. Each of these steps perform the same function, and that is whether the direction of control has been reversed so that there is a need to compare the oxygen sensor output voltage with the respective reference voltages. If a reverse direction is required, then from the steps S185 and S186 the program moves to the steps S187 and S188, respectively, so as to set up a reverse flag.

It should be noted that if the determination at the step S181 indicates that this is the first cycle of feedback control, the program moves also the step S187 so as to set this reverse flag so as to determine when the reversal has occurred.

If, however, at the steps S185 and S186 the reverse control is not necessary for the oxygen sensor output to be compared with the reference voltages, the program moves to the respective steps S189 and S190 so as to clear the reverse flags.

Once the reverse flag is set at the step S181, the program moves to the step S191 to set up the control for the reverse direction. In other words, the control will then be set to go rich. In a like manner, after the flag has been set at the step S188, then the program moves to the step S192 so as to shift to set up for lean direction operation. From the steps S191 and S192 the program returns.

It should be noted when the flag is cleared at the step S190, then the program moves to the step S191 so as to set up for reverse direction operation or, that is, for rich adjustment.

Figure 28:
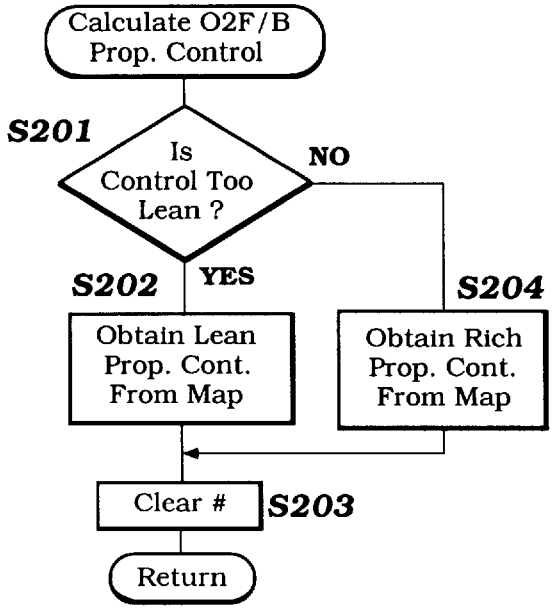
FIG. 28 is a block diagram showing yet another portion of the control routine utilized in the routine of FIG. 25.

As noted in the description of FIG. 25, the determination of the $O_2$ feedback sensor proportional component at the step S128 is performed by a calculation. This calculation step is shown in FIG. 28 and will now be described by reference to that figure. The program begins at the step S201 and confirms whether the control is being made in the lean direction or not. If it is, the program moves then to the step S202 to obtain the lean direction proportional constant P2 from the chart or map of FIG. 22 in relation to engine speed. The program then moves to the step S203 to clear the integer numbers and return.

If, however, at the step S201 it is determined that the control is not lean, then the program moves to the step S204 to obtain the rich direction proportional constant P1 from the map of FIG. 22. Again, this is in relation to engine speed, and then the program moves to the step S203 to clear.

Figure 29:
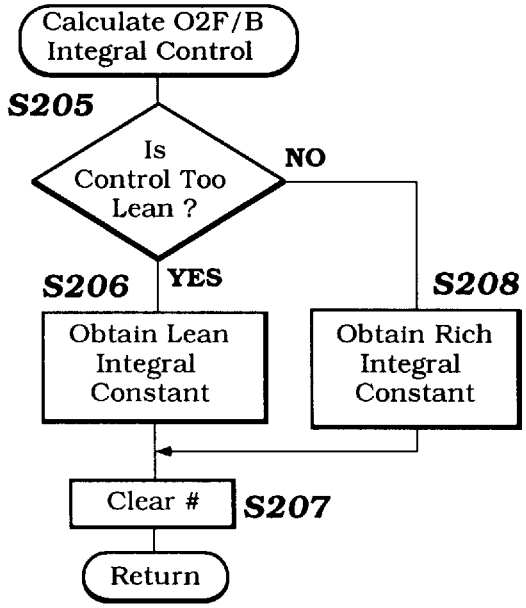
FIG. 29 is a block diagram showing still a further portion of the control routine utilized in the routine of FIG. 25.

The way in which the $O_2$ sensor integral constant at the step S131 of FIG. 25 will now be described by reference to FIG. 29. This program begins and then moves to the step S205 to determine whether the adjustment of the air/fuel ratio is being made in the lean direction. If it is, the program at the step S206 obtains the lean direction integral constant from the appropriate map of FIG. 22 to select the value of I2 based upon engine speed. The program then moves to the step S207 so as to clear the incremental integral numbers and returns. If, however, at the step S205 the control is not to the lean stage, then the program moves to the step S208 so as to obtain the rich integral constant I1 from the map of FIG. 22, again in relation to engine speed. The program then moves to the step S207 to clear the number.

The way in which the compensation factor is learned will now be described by particular reference first to FIG. 30. Certain data is generated, depending upon throttle angle and engine speed, and this data is only collected when the throttle opening and engine speed is in the shaded range, as shown in the upper right side portion of this figure. In addition, the learning is only accomplished when the throttle opening V and engine speed in rpm are more than a certain amount for more than a predetermined time period and have not had significant fluctuation.

Assuming that the engine is operating in the upper portion of FIG. 30, and this will be described later by particular reference to FIG. 31, the system then moves to the lower curve wherein data is gathered. Again, the data shows the fluctuations on the rich and lean sides, with the rich data being indicated at $\lambda_0'$, $\lambda_1$, $\lambda_3$, $\lambda_5$, and $\lambda_7$, while the lean side readings are at $\lambda_0$, $\lambda_2$, $\lambda_4$, and $\lambda_6$. The system operates so as to take the averages of the readings between the low and high sides and then sum these averages. This is then utilized to update or set a new base value for subsequent feed back control.

Figure 30:
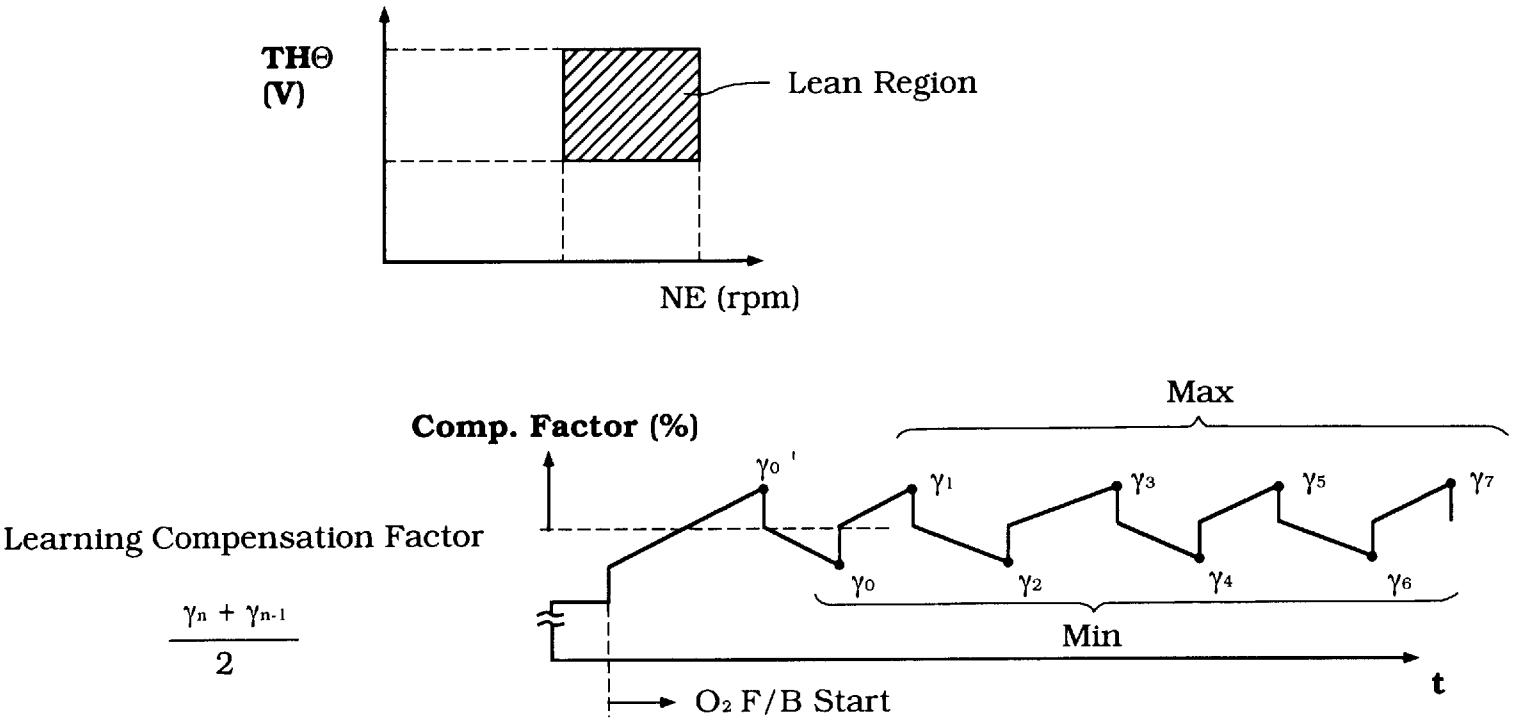
FIG. 30 is a graphical view showing, in the upper portion, the various control routines leading up to the learning condition and, in the lower portion, a graphical view with time showing how the learning data is accumulated for updating the memory.
Figure 31:
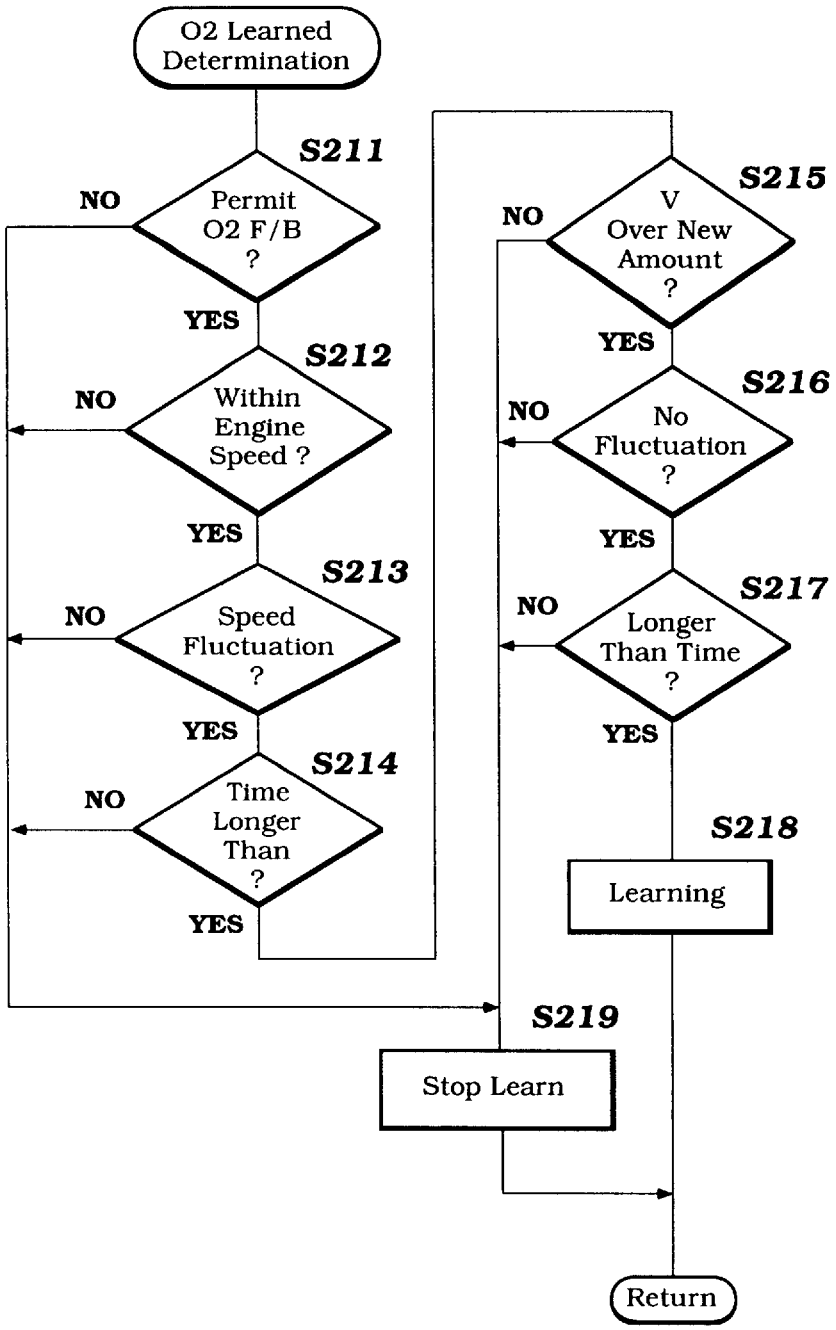
FIG. 31 is a graphical view showing how the program operates at the step S103 in FIG. 24 to determine when the learning routine will be followed and employed.

This is done as seen in FIG. 31. The program begins at the step 211 to determine if the engine is running in a condition wherein feedback control is permitted. If it is not, due to the various factors already mentioned, the program skips ahead. If, however, the feedback control is in the permissible range this being equivalent to the step S102 of FIG. 24, the program moves to the step S212 to determine if the engine speed is above the speed indicated in the upper graphical view of FIG. 30. If it is not, the program repeats.

If, however, at the step S212 it is determined that the engine speed is above the predetermined range where learning is desired, the program moves to the step S213 to compare the engine speed with earlier speeds to determine if the speed fluctuation is relatively small. If it is not, the program skips ahead.

If, however, at the step S213 it is determined that the engine speed is fluctuating within a small range and above that shown in the shaded portion of FIG. 30, the program moves to the step S214 to determine the length of time which the engine has been running at this speed. If the time is not sufficient, the program skips ahead and avoids the learning.

If, however, the engine speed has not been fluctuating more than a predetermined amount and is within the desired range for the desired time period, then the program moves to the step S215 to determine if the throttle valve setting θ is more than the value V. This is normally a mid-range throttle opening. If the throttle opening is not within this range, then the shaded area shown in FIG. 30 is not present, and the program skips ahead.

If, however, the engine throttle valve has been in the predetermined range, then the program moves to the step S216 to determine the magnitude of fluctuations from previous readings. Again, if the throttle valve position is fluctuating widely, the program will skip ahead and stop the feedback learning curve.

If, however, at the step S216 it is determined that the throttle valve is not fluctuating greatly, then the program moves to the step S217 so as to determine how long the throttle valve position has been in the desired range. If the time period is too short, the program skips ahead.

If, however, at the step S217 all of the noted criteria have been reached, then the program moves to the step S218 so as to permit oxygen feedback control learning. If the answer was negative at any of the steps S211–S217, the program would have skipped to the step S219 to disable feedback learning and to repeat.

Figure 32:
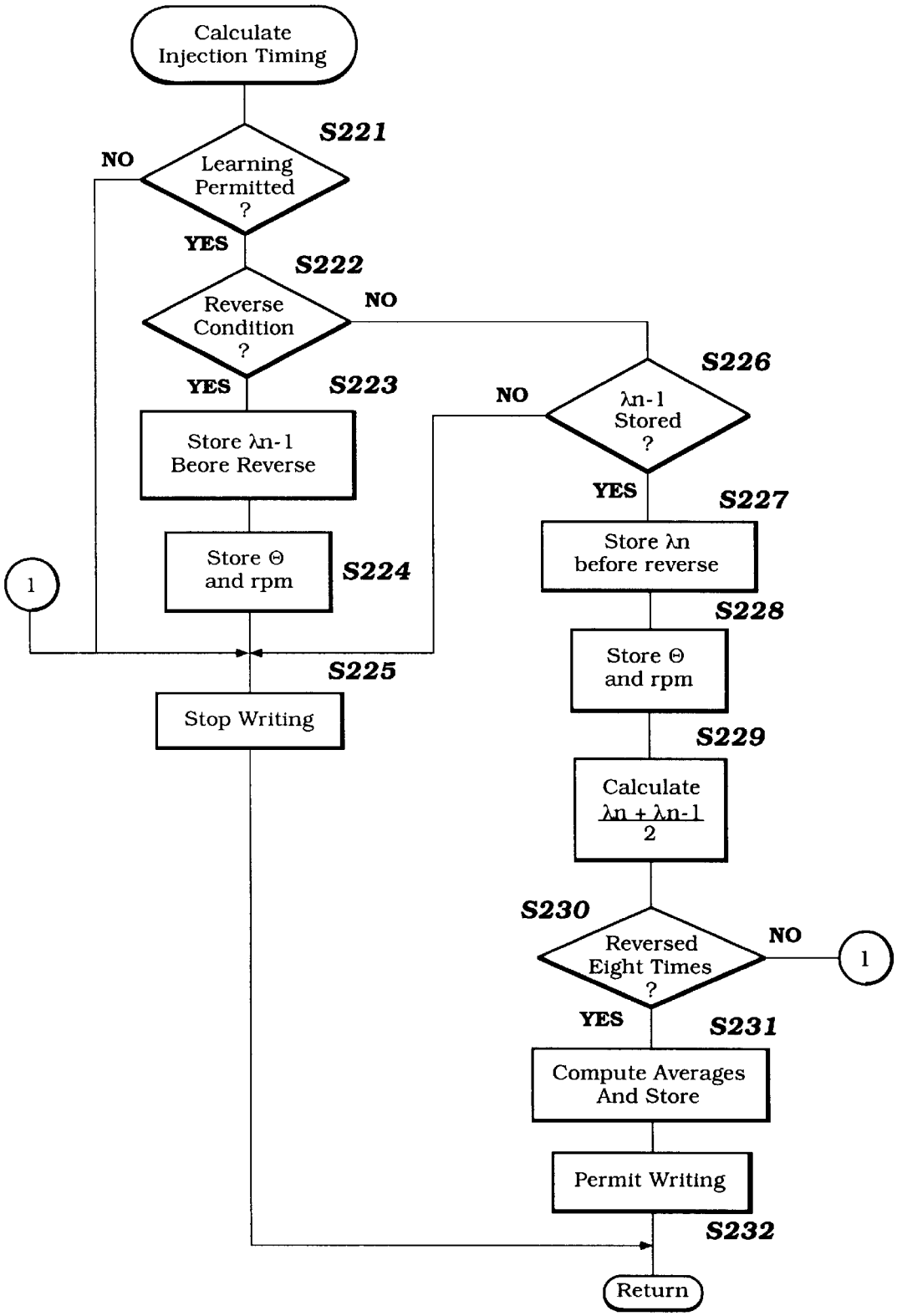
FIG. 32 is a further graphical view showing how the learning data in the memory is updated after the step S104 in FIG. 24.

The process by which the injection time is learned will now be described by reference to FIG. 32. The program begins and moves to the first step of S221 to determine if the system is still in the condition when $O_2$ feedback control learning is permitted. If it is not, the program steps ahead. If however it is, then the program moves to the step S222 to determine whether the curve, for example, that shown on the lower portion of FIG. 30, is moving from the rich to the lean or from the lean to the rich side. If it is moving from the rich to the lean side, the program then moves to the step S223 so as to store a new compensation factor $\lambda_{n-1}$ that existed before the reverse condition. These are the values shown at odd numbers on FIG. 30. The program then moves to the step S224 so as to store the actual throttle angle and engine speed just before the reversal so as to provide a compensation factor and throttle angle engine speed reading. The program then moves to the step S225 so as to discontinue the learning process.

If, however, at the step S222 the condition was such that the reversal from the rich to the lean side had taken place, and then the mixture is going from lean to rich, the program moves to the step S226 to determine if the value of $\lambda_{n-1}$ has already been stored. If it is not, the program moves to the step S225 to stop writing the learned value.

If, however, at the step S226 it has been learned that the compensation factor $R_{n-1}$ before reverse had been stored, then the program moves to the step S227 so as to store the new compensation factor $\lambda_n$ before the reverse.

The program then moves to the step S228 so as to take the throttle angle and engine speed readings for the value at the reversal the same as at step S224.

The program then moves to the step S229 so as to calculate the average compensation factor by summing $\lambda_{n-1}$ and $\lambda_n$ and dividing it by 2.

The program then moves to the step S230 to determine if there have been eight reversals. This number is chosen because it is a reasonable time limit for values and provides adequate sampling for good performance.

If at the step S230 there have been eight reversals, then the program moves to the step S231 to compute the average of the learned compensation values for the engine speed average and average throttle angle and then store them. The program then moves to the step S232 so as to write in this predetermined value, this being the step S105 in FIG. 24. The program then returns.

Figure 33:
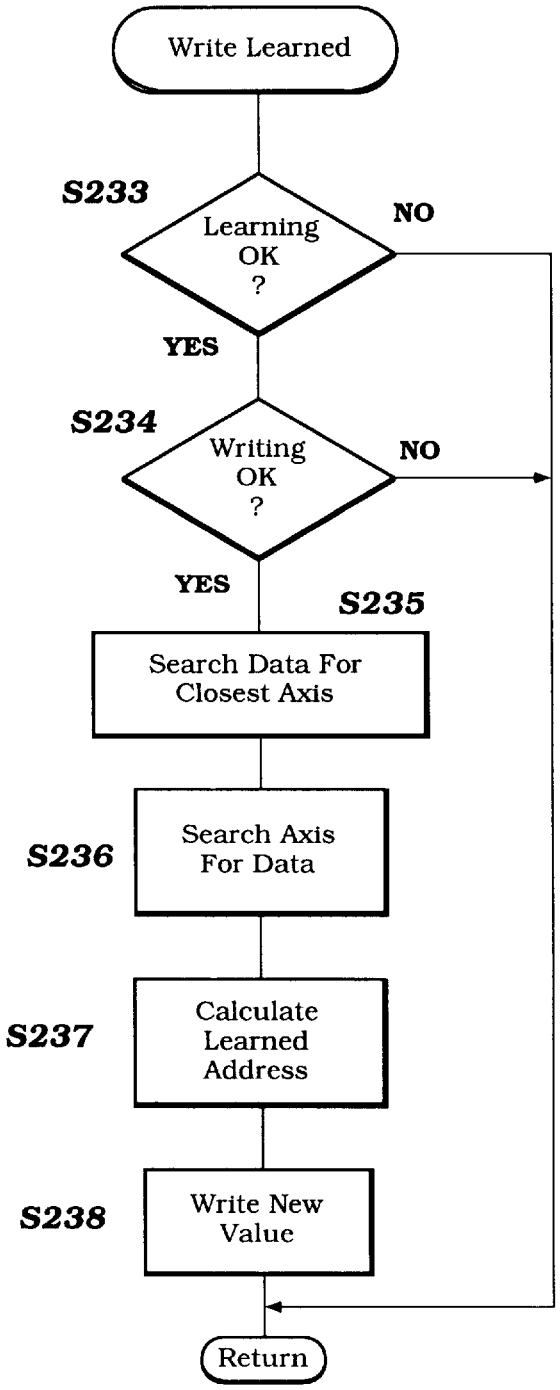
FIG. 33 is a further graphical view the writing of the results of the learning curve at the step S105 in FIG. 24.

The manner of writing in the fuel injection volume or time interval at the step S105 may be understood by reference to FIG. 33. In this control routine, the program starts to write in the learned injection volume, and first, moves to the step S233 to ascertain that oxygen feedback learning is still permitted. If it is not, the program skips ahead.

If the answer has been affirmative at the step S233, the program moves to the step S234 so as to determine if writing of the learned volume is permitted. If it is not, the program skips ahead. It however, writing is permissible, then the program moves to the step S235 so as to search the map for the closest axis to the stored average throttle angle. The program then moves to the step S236 to search the data of the learning axis which is closest to the stored average engine speed.

The program then moves to the step S237 so as to calculate the learned injection volume writing address from the throttle angle and engine speed data. Then, at the step S238, the new information is written into the map to replace the old information.

Thus, it should be readily apparent from the foregoing description that the described method is extremely effective in permitting the use of feedback control and also for reading in updated information for the basic calculations so as to minimize the amount of hunting required. Of course, the foregoing description is that of preferred embodiments of the invention, and various changes and modifications may be made without departing from the spirit and scope of the invention, as defined by the appended claims.

What is claimed is:

1. An internal combustion engine comprising a combustion chamber, an air-fuel charging system for delivering an air and fuel charge to said combustion chamber for combustion therein, a combustion condition sensor for determining the air/fuel ratio in said combustion chamber, control means for adjusting the air/fuel ratio delivered to said combustion chamber, said control means including a feedback mode for adjusting the air/fuel ratio delivered to said combustion chamber in response to the output of said combustion condition sensor, said feedback mode operational when said engine is operating in a first operational range, said control means further including a learning mode and a memory for storing corrective data from said sensor during operation of said learning mode, said learning mode operational in a second engine operational range narrower than but within said first operational range, said control means utilizing the contents of said memory for subsequent control of said engine air/fuel ratio.

2. An internal combustion engine as set forth in claim 1 wherein the control means sets a basic air/fuel ratio and the combustion condition sensor is employed by said control means in said feedback mode to adjust the ratio from the basic air/fuel ratio.

3. An internal combustion engine as set forth in claim 2 wherein the basic air/fuel ratio is initially set based on engine running conditions.

4. An internal combustion engine as set forth in claim 3 wherein the contents of the memory are used to update the basic air/fuel ratio from the corrective data.

5. An internal combustion engine as set forth in claim 4 wherein the engine conditions at which the corrective data is taken are also memorized.

6. An internal combustion engine as set forth in claim 1 wherein the corrective data is averaged from the data when the air/fuel ratio shifts between rich and lean sides of the desired ratio.

7. An internal combustion engine as set forth in claim 6 wherein the control means sets a basic air/fuel ratio and the combustion condition sensor is employed by said control means in said feedback mode to adjust the ratio from the basic air/fuel ratio.

8. An internal combustion engine as set forth in claim 7 wherein the basic air fuel ratio is initially set based on engine running conditions.

9. An internal combustion engine as set forth in claim 8 wherein the contents of the memory are used to update the basic air/fuel ratio from the corrective data.

10. An internal combustion engine as set forth in claim 9 wherein the engine conditions at which the corrective data is taken are also memorized.

11. An internal combustion engine as set forth in claim 10 wherein said second operational range is when said first operational range exists and said air/fuel ratio is lean.

12. A method of operating an internal combustion engine as set forth in claim 11 further including the steps of averaging the corrective data from the data when the air/fuel ratio shifts between rich and lean sides of the desired ratio.

13. A method of operating an internal combustion engine as set forth in claim 11 wherein said step of determining if said engine is operating in a second operating condition further comprises the step of determining if said air/fuel ratio is lean.

14. A method of operating an internal combustion engine as set forth in claim 11 wherein said step of determining whether said second engine operating condition exists includes the step of determining if said air/fuel ratio is between 15 and 16 to 1.

15. A method of operating an internal combustion engine as set forth in claim 11 wherein said step of determining whether said first engine operating condition exists includes the step of determining if said sensor has reached an operating temperature.

16. A method of operating an internal combustion engine as set forth in claim 11 further including the step of utilizing the contents of said memory for subsequent control of said engine air/fuel ratio.

17. A method of operating an internal combustion engine as set forth in claim 16 further including the step of setting a basic air/fuel ratio from a map of an air/fuel control and wherein said step of utilizing the contents of said memory comprises utilizing said contents when data from said map is inaccessible.

18. A method of operating an internal combustion engine as set forth in claim 11, wherein said step of determining whether said engine is operating in a second engine operating range comprises determining if said engine is operating at a mid-range rotational velocity and throttle angle.

19. A method of operating an internal combustion engine comprising a combustion chamber, an air-fuel charging system for delivering an air and fuel charge to said combustion chamber for combustion therein, a combustion condition sensor for determining the air/fuel ratio in said combustion chamber, said method comprising the steps of determining whether said engine is operating in a first engine operating range, adjusting the air/fuel ratio delivered to said combustion chamber in response to the output of said combustion condition sensor with a feedback control means, determining if said engine is operating in a second operating range within said first operating range, and if so employing a learning mode including the step of storing corrective data from said feedback control means in a memory.

20. A method of operating an internal combustion engine as set forth in claim 19 further comprising the steps of setting a basic air/fuel ratio with said feedback control means and adjusting the ratio from the basic air/fuel ratio with said output from said sensor.

21. A method of operating an internal combustion engine as set forth in claim 20 further including the step of setting the basic air fuel ratio initially based on engine running conditions.

22. A method of operating an internal combustion engine as set forth in claim 21 further including the step of using the contents of the memory to update the basic air/fuel ratio from the corrective data.

23. A method of operating an internal combustion engine as set forth in claim 22 further including the step of storing data regarding the engine conditions at which the corrective data is taken.

* * * * *